US008333299B2

(12) United States Patent
Kemper et al.

(10) Patent No.: US 8,333,299 B2
(45) Date of Patent: Dec. 18, 2012

(54) LEAK RESISTANT DRINKING CUP

(75) Inventors: Bernard J. Kemper, Bonne Terre, MO (US); Charles H. Miller, Barnhart, MO (US)

(73) Assignee: Handi-Craft Company, St. Louis, MO (US)

( * ) Notice: Subject to any disclaimer, the term of this patent is extended or adjusted under 35 U.S.C. 154(b) by 621 days.

(21) Appl. No.: 12/471,124

(22) Filed: May 22, 2009

(65) Prior Publication Data

US 2010/0294764 A1 Nov. 25, 2010

(51) Int. Cl.
*A47G 19/22* (2006.01)

(52) U.S. Cl. .... 220/719; 220/714; 220/717; 220/203.18

(58) Field of Classification Search ..... 220/203.18, 220/203.19, 203.29, 714, 303, 254.1, 255, 220/256.1, 719, 713, 367.1, 360, 710.5, 203.01, 220/202, 203.09, 203.11, 203.16, 717; 215/11.4, 215/260, 270, 11.5, 11.1, 387, 388, 389; 222/490

See application file for complete search history.

(56) References Cited

U.S. PATENT DOCUMENTS

| | | | | |
|---|---|---|---|---|
| 2,442,656 | A | 6/1948 | Less | |
| 3,915,331 | A | 10/1975 | Chenault | |
| 4,066,191 | A * | 1/1978 | Coleman | 222/569 |
| 4,135,513 | A | 1/1979 | Arisland | |
| 4,623,069 | A | 11/1986 | White | |
| 4,993,568 | A | 2/1991 | Morifuji et al. | |
| 5,071,017 | A | 12/1991 | Stull | |
| 5,079,013 | A | 1/1992 | Belanger | |
| 5,101,991 | A | 4/1992 | Morifuji et al. | |
| 5,101,992 | A | 4/1992 | Serre | |
| 5,186,347 | A | 2/1993 | Freeman et al. | |
| 5,542,670 | A | 8/1996 | Morano | |
| 5,570,796 | A | 11/1996 | Brown et al. | |
| 5,598,809 | A | 2/1997 | McInnes | |
| 5,667,084 | A | 9/1997 | Duggal et al. | |
| 5,690,679 | A | 11/1997 | Prentiss | |

(Continued)

FOREIGN PATENT DOCUMENTS

WO 02100320 A1 12/2002

(Continued)

OTHER PUBLICATIONS

International Search Report and Written Opinion from PCT/US/2010/035719 dated Jul. 20, 2010, 6 pages.

*Primary Examiner* — Jacob K Ackun
*Assistant Examiner* — Jenine Pagan
(74) *Attorney, Agent, or Firm* — Armstrong Teasdale LLP

(57) ABSTRACT

A leak resistant drinking cup has a container with an open top and a lid assembly for removable attachment to the container for selectively closing the open top. The lid assembly includes a liquid discharge member for allowing liquid in the container to exit the cup. A closure member is adapted for placement adjacent the open top of the container when the lid assembly is attached to the container. A flexible diaphragm is moveable between a sealed position and an unsealed position. The diaphragm is moveable from the sealed position to the unsealed portion by a vacuum being applied to the diaphragm by a user sucking on the liquid discharge member. The vacuum causes the diaphragm to flex toward the container and at least in part away from the closure member and thereby move the diaphragm from the sealed position to the unsealed position.

29 Claims, 30 Drawing Sheets

U.S. PATENT DOCUMENTS 5,706,973 A 1/1998 Robbins, III et al.
5,747,083 A 5/1998 Raymond et al.
5,779,071 A 7/1998 Brown et al.
5,791,503 A 8/1998 Lyons
5,890,619 A 4/1999 Belanger
5,890,620 A 4/1999 Belcastro
5,890,621 A 4/1999 Bachman et al.
5,950,857 A 9/1999 Rosen
5,988,425 A 11/1999 Yehl et al.
6,037,872 A 3/2000 Dunnum
6,050,445 A 4/2000 Manganiello
6,079,589 A 6/2000 Matsuyama et al.
D429,312 S 8/2000 Poirier et al.
6,102,244 A 8/2000 Kuwano et al.
6,102,245 A 8/2000 Haberman
6,116,457 A 9/2000 Haberman
D433,729 S 11/2000 Poirier et al.
RE37,016 E 1/2001 Morano
6,202,877 B1 3/2001 La Torre et al.
6,230,923 B1 5/2001 Hung
6,260,731 B1 7/2001 Cummings
6,269,968 B1 8/2001 Belcastro
D448,242 S 9/2001 McDonough et al.
D448,976 S 10/2001 McDonough et al.
6,305,570 B1 10/2001 Atkin et al.
D450,535 S 11/2001 McDonough et al.
6,321,931 B1 11/2001 Hakim et al.
6,325,236 B1 12/2001 Wong
6,357,620 B1 3/2002 Hakim
6,365,202 B1 4/2002 Ida et al.
6,422,415 B1 7/2002 Manganiello
6,502,418 B2 1/2003 Holley, Jr.
6,508,379 B1 1/2003 Van De Pol-Klein Nagelvoort et al.
6,513,379 B2 2/2003 Meyers et al.
6,554,023 B2 4/2003 Danby et al.
6,565,743 B1 5/2003 Poirier et al.
6,568,557 B2 5/2003 Fusco et al.
6,607,092 B2 8/2003 Manganiello et al.
6,609,630 B1 8/2003 Freeman et al.
6,629,624 B2 10/2003 Stillinger et al.
6,631,823 B2 10/2003 Stillinger et al.
6,631,832 B2 10/2003 Wan et al.
6,644,510 B2 11/2003 Kawolics et al.
6,685,042 B2 2/2004 McIntyre et al.
6,732,882 B2 5/2004 Belcastro
6,758,364 B1 7/2004 Rohrig
6,783,020 B2 8/2004 Featherston et al.
6,786,352 B2 9/2004 Belcastro
RE38,692 E 2/2005 Wong
6,863,083 B2 3/2005 Danby et al.
7,108,676 B2 9/2006 Loging
7,243,814 B2 7/2007 Hakim
D555,428 S 11/2007 Tulett
D559,622 S 1/2008 Carreno
7,556,172 B2 * 7/2009 Lane ..... 220/714
7,575,126 B2 8/2009 Kemper
2001/0020623 A1 9/2001 McDonough et al.
2001/0027956 A1 10/2001 Bonacorso et al.
2001/0035420 A1 11/2001 Fusco et al.
2002/0033399 A1 3/2002 Manganiello et al.
2002/0158075 A1 10/2002 Caldicott et al.
2002/0179615 A1 12/2002 Hakim
2002/0185495 A1 12/2002 Manganiello
2002/0189683 A1 12/2002 Danby et al.
2003/0209555 A1 * 11/2003 Belcastro ..... 220/714
2004/0035815 A1 * 2/2004 Webb et al. ..... 215/11.4
2004/0099674 A1 5/2004 McDonough et al.
2004/0124170 A1 7/2004 Sherrod
2004/0173623 A1 9/2004 Yuen
2004/0222229 A1 11/2004 Gabbard
2005/0045647 A1 3/2005 Hession et al.
2005/0072788 A1 4/2005 Lieberman et al.
2005/0098567 A1 * 5/2005 Randolph ..... 220/710.5
2005/0167438 A1 8/2005 Minyayev
2005/0205589 A1 9/2005 Davis et al.
2006/0037963 A1 2/2006 Pillado
2006/0151499 A1 7/2006 Lieberman et al.
2006/0169694 A1 * 8/2006 Kemper ..... 220/303
2007/0138121 A1 6/2007 Stribling et al.

FOREIGN PATENT DOCUMENTS

WO 03068036 A1 8/2003
WO 2008125877 A1 10/2008

* cited by examiner

LEAK RESISTANT DRINKING CUP

BACKGROUND

This invention relates generally to leak resistant drinking cups and more particularly to a leak resistant drinking cup having a diaphragm that is moveable between a sealed position and an unsealed position.

Leak resistant drinking cups are often adapted for use by young children (e.g., infants, toddlers, preschoolers). These types of drinking cups are configured so that when they are turned over, liquid inside the cup is prevented from spilling out of the cup by a valve or valve assembly. Usually, the cup includes a container with an open top for receiving and holding liquids therein and a relatively rigid cover for closing the open top of the container. A spout is typically formed as one-piece with the rigid cover for allowing a child to drink from the cup. The cover can be releasably attached (e.g., snapped or screwed on) to the container.

The valve or valve assembly is typically disposed between the cover and the container and can be moved from a closed, sealing position to an opened, unsealing position to allow liquid to pass out of the cup for drinking. Most commonly, the valve is actuated by a vacuum pressure applied by the user to the interior of the cup by sucking on the spout. The applied vacuum pressure causes the valve to move or otherwise deform in such a way (i.e., move toward the spout) that a path past the valve is exposed so liquid can flow out of the cup. It is possible that the valve might be actuated in other ways, such as a purely mechanical actuation, but for young children vacuum pressure actuation is most preferable because the only time the valve is open is when the child is in the act of taking a drink.

Vacuum pressure actuated drinking cups of the type just described have certain problems generally associated with balancing the need to assure positive sealing with the need to make the cup easy to use for the child. A strong seal by the valve requires a relatively large vacuum to open, making it hard for the child to use. A valve having a seal that requires a lower vacuum pressure to open may not seal tightly enough to prevent at least some liquid flowing past it, especially when dropped, swung, shaken, or impacted. Thus, valves having low vacuum pressure actuated seals are typically prone to leak.

Frequently, conventional valves are relatively small and located under the spout. These types of valves often require a substantial vacuum pressure to actuate because the pressure acts on only a relatively small area of the valve. In other words, children will have to suck with significant effort to get the valve to open and obtain a drink, which makes the cup less desirable to the child.

In one conventional configuration, the valve or valve assembly can be permanently attached to the cover. During normal use of the cup, the valve or valve assembly will become fouled with liquid and particulates in the liquid. Although cleaning is possible, it is very difficult to clean the entire valve/valve assembly or the entire cover. Disassembly of the valve/valve assembly from the cover in this type of configuration would result in destruction of the valve/valve assembly or cover. As a result, it is difficult for caregivers to provide the child with a drinking cup that has a clean valve/valve assembly and cover in repeated uses of these types of drinking cups.

In another conventional configuration, the valve or valve assembly can be disassembled from the cover for cleaning. Even with the capability of being disassembled for cleaning, some known valves and valves assemblies are still prone to fouling. Some valves and valve assemblies are difficult to detach and reassemble as they require precise alignment or orientation. Moreover, small valves or pieces of a valve assembly may be easily lost or pose a danger to the child if the cup becomes disassembled.

BRIEF DESCRIPTION

In one aspect, a leak resistant drinking cup generally comprises a container for receiving and holding a quantity of liquid for drinking. The container has an open top. A lid assembly is adapted for removable attachment to the container for selectively closing the open top. The lid assembly comprises a liquid discharge member for allowing liquid in the container to exit the cup during drinking. A closure member is adapted for placement adjacent the open top of the container when the lid assembly is attached to the container. A flexible diaphragm is moveable between a sealed position in which the diaphragm blocks the flow of liquid from the container to the liquid discharge member, and an unsealed position in which liquid is permitted to flow from the container to the liquid discharge member. The diaphragm is moveable from the sealed position to the unsealed portion by a vacuum being applied to the diaphragm by a user sucking on the liquid discharge member. The vacuum causes the diaphragm to flex toward the container and at least in part away from the closure member and thereby move the diaphragm from the sealed position to the unsealed position.

In another aspect, a leak resistant drinking cup generally comprises a container for receiving and holding a quantity of liquid for drinking. The container has an open top. A lid assembly is adapted for removable attachment to the container for selectively closing the open top. The lid assembly comprises a liquid discharge member for allowing liquid in the container to exit the cup during drinking. A flexible diaphragm is moveable between a sealed position in which the diaphragm blocks the flow of liquid from the container to the liquid discharge member, and an unsealed position in which liquid is permitted to flow from the container to the liquid discharge member. The diaphragm is biased toward the sealed position and away from the container.

Another aspect is generally directed to a leak resistant drinking cup generally comprising a container for receiving and holding a quantity of liquid for drinking. The container has an open top. A lid assembly is adapted for removable attachment to the container for selectively closing the open top. The lid assembly comprises a liquid discharge member for allowing liquid in the container to exit the cup during drinking. A closure member is adapted for placement adjacent the open top of the container when the lid assembly is attached to the container. A flexible diaphragm is moveable between a sealed position in which the diaphragm blocks the flow of liquid from the container to the liquid discharge member, and an unsealed position in which liquid is permitted to flow from the container to the liquid discharge member. The diaphragm is moved toward its sealed position by pressure within the container.

BRIEF DESCRIPTION OF THE DRAWINGS

Corresponding reference characters indicate corresponding parts throughout the several views of the drawings.

DETAILED DESCRIPTION OF THE DRAWINGS

Figure 1:
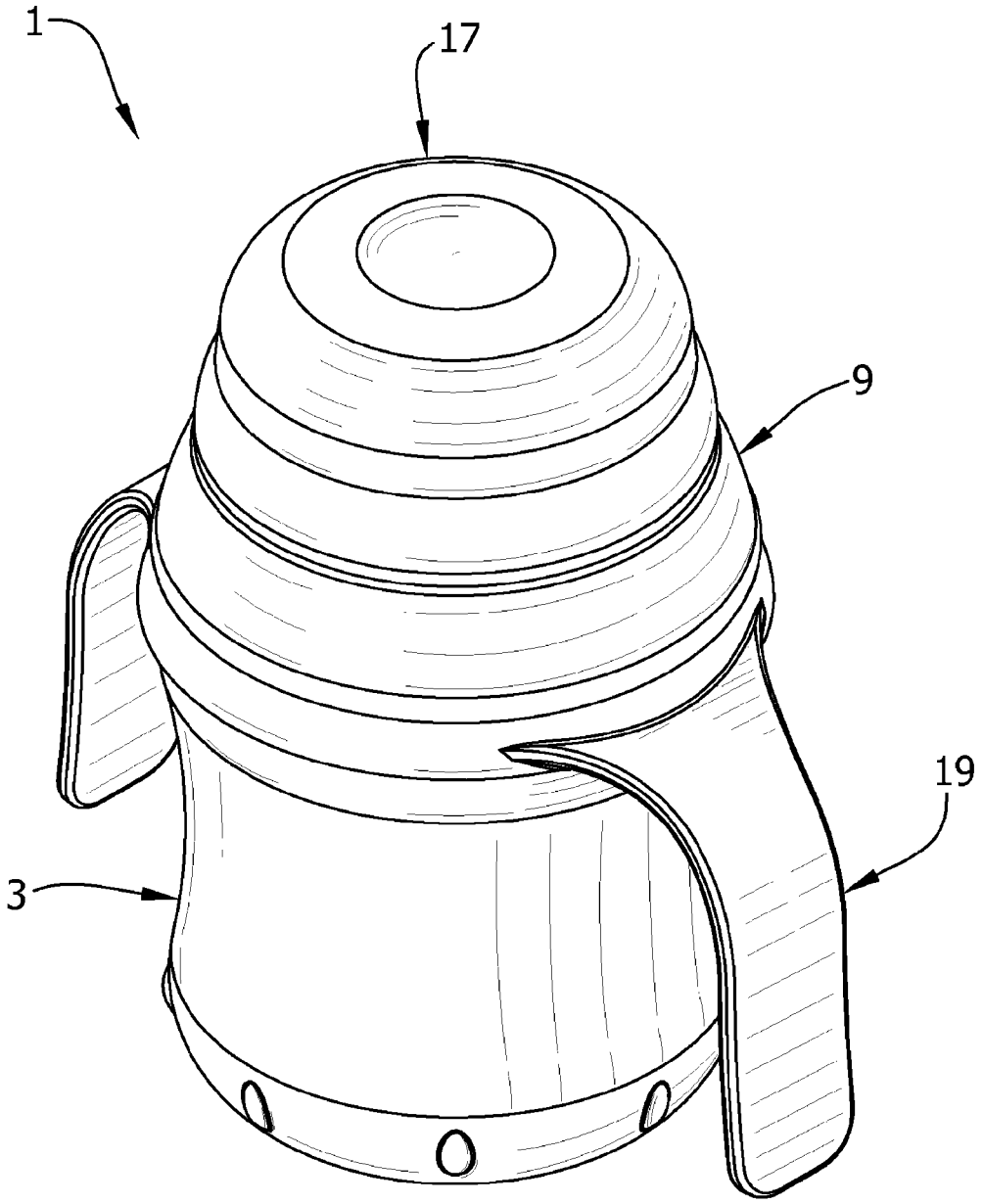
FIG. 1 is a perspective of one embodiment of a leak resistant drinking cup.
Figure 2:
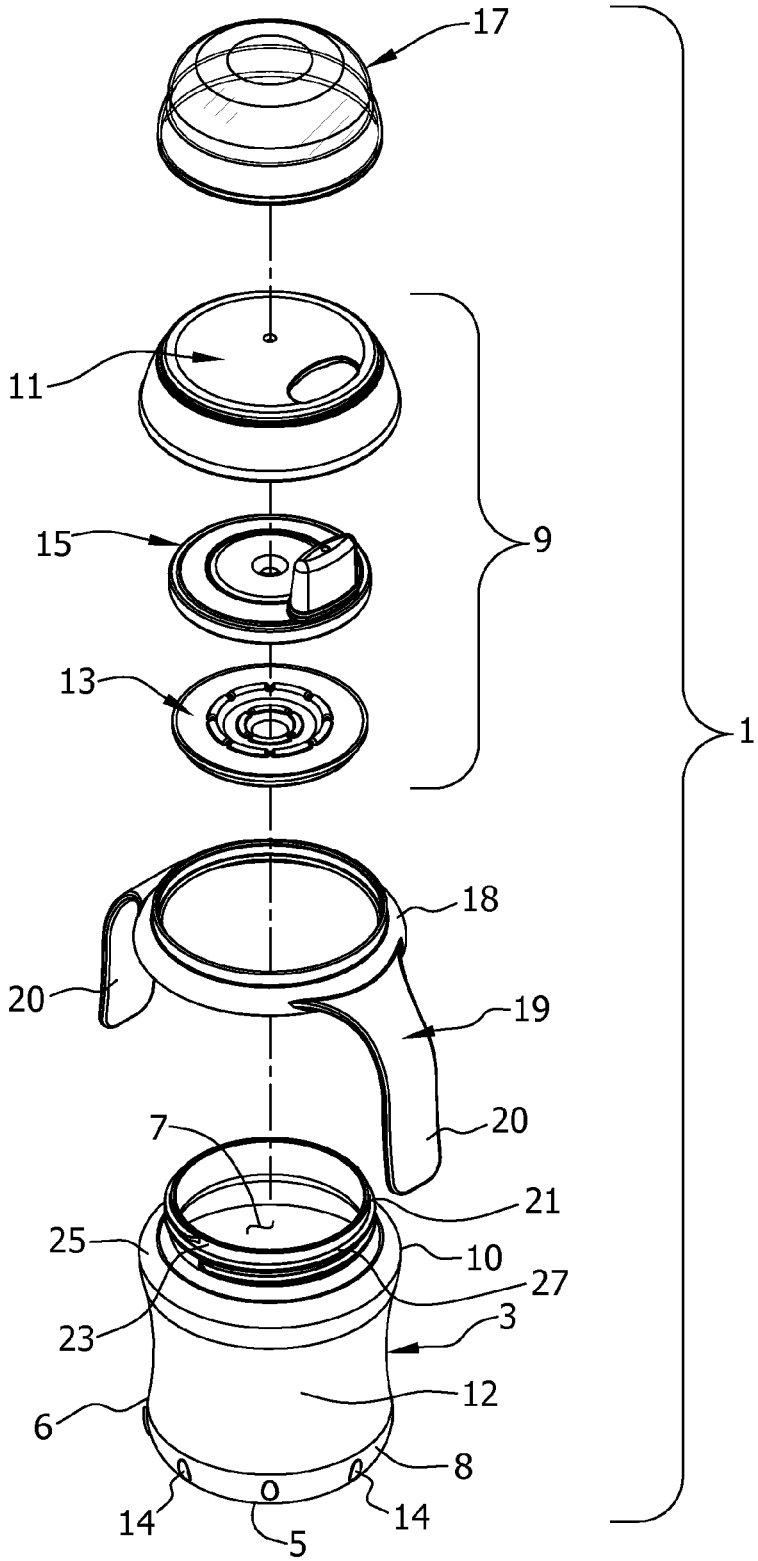
FIG. 2 is an exploded perspective of the cup.

Referring now to the drawings and in particular to FIGS. 1 and 2, a leak resistant drinking cup, generally indicated at 1, includes a container, which is generally indicated at 3, and a lid assembly, which is generally indicated at 9. The illustrated container 3 is generally cylindrical and symmetric about a central axis. The container 3 has a closed bottom 5, an open top 7, and a generally cylindrical side wall 6 extending between the closed bottom and the open top. The cylindrical side wall 6 includes a base portion 8, a top portion 10, and a concaved middle portion 12 extending between the base and top portions. The middle portion 12 of the side wall 6 of the illustrated container 3 is concaved to facilitate grasping of the container and thereby the cup 1. It is understood, however, that the middle portion 12 can be convex or generally straight. The base portion 8 of the side wall 6 includes a plurality of circumferentially spaced-apart nubs 14. The top portion 10 of the side wall 6 has a circular upper edge 21, an attachment collar 23 disposed beneath and adjacent to the upper edge, and a shoulder 25 disposed below the attachment collar. The attachment collar 23 has external threads 27 thereon.

Figure 3:
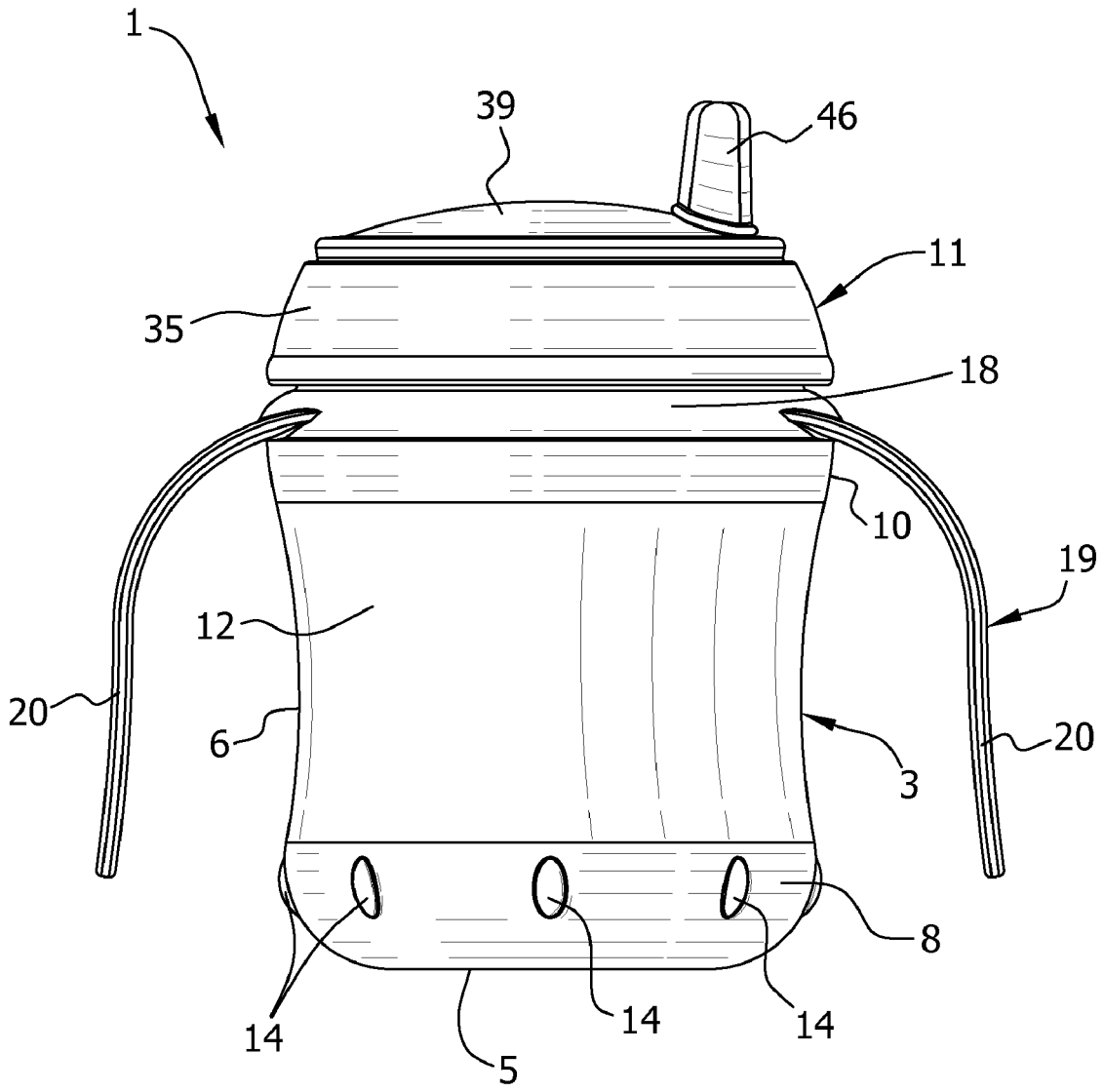
FIG. 3 is a side elevation of the cup with a lid removed therefrom.
Figure 23:
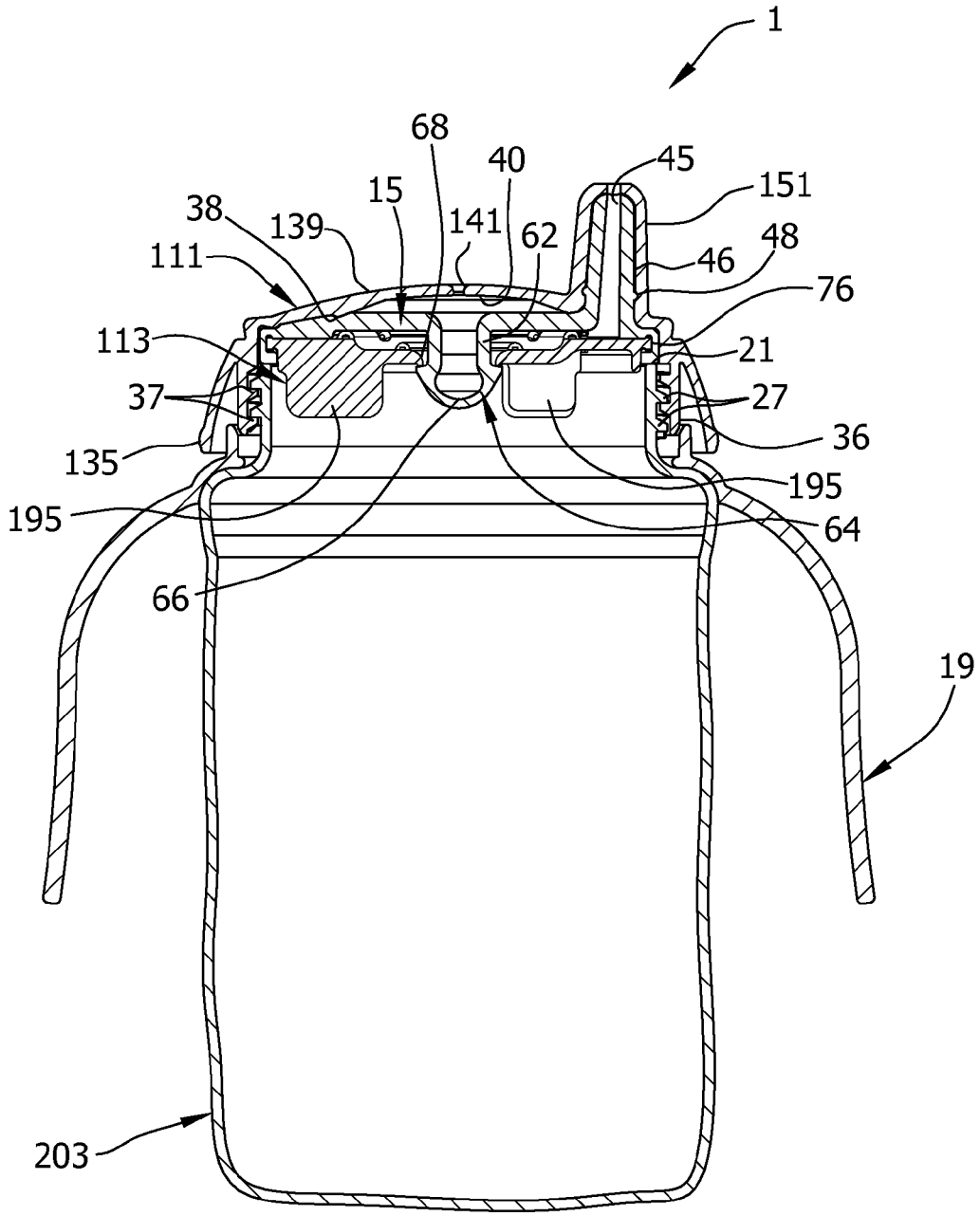
FIG. 23 is a vertical cross-section of the cup having a non-rigid container.

The illustrated container 3 has a liquid chamber adapted to hold a quantity of liquid for consumption by a user, such as a small child. More specifically, the illustrated container 3 is adapted to hold approximately 6 ounces of liquid. It is to be understood, however, that the cup 1 can be sized to hold other quantities of liquid (e.g., 9 ounces, 12 ounces, 20 ounces, etc.). For example, the container 3 can be adapted for older children or adults and hold larger quantities of liquid. It is also understood that the container 3 can have a different configuration than the one illustrated herein, such as a sports bottle, a drink tumbler, a commuter cup, etc. The container 3 can be made of any suitable material such as, without limitation, polypropylene, aluminum, or stainless steel. The container 3 can also be made in any desired color or colors, and may be transparent, translucent, or opaque. The container 3 can be rigid as illustrated in FIGS. 1-3 or non-rigid as illustrated in FIG. 23.

The lid assembly 9 of the cup 1 is adapted for removable attachment to the container 3 for selectively closing the open top 7 of the container. The lid assembly 9, as illustrated in FIG. 2, comprises a cover 11, a closure member 13, and a diaphragm 15 disposed between the cover and the closure member (each of the lid assembly components being indicated generally by their respective reference numbers). As described in more detail below, the diaphragm 15 is operable to block the flow of liquid from the container 3 to prevent liquid from being spilled when the cup 1 is tipped over. The diaphragm 15 can be deflected, flexed, or otherwise moved by an application of vacuum pressure applied by a user drinking from the cup to permit liquid in the container 3 to flow past the diaphragm and out of the cup. The cover 11, closure member 13, and diaphragm can be made of any suitable materials. In one embodiment, the cover 11 and closure member 13, for example, can be made of polypropylene and the diaphragm 15 can be made of silicone. The cover 11, closure member 13 and diaphragm 15 can be made in any desired color or colors, and may be transparent, translucent, or opaque.

The illustrated cup 1 also includes a cap, indicated generally at 17, that is removeably securable to the cover 11 via a snap-fit connection. The cap 17 can be selectively placed on the cover 11 during periods of non-use (e.g., storage, travel) of the cup 1, as illustrated in FIG. 1, and removed during periods of use. The cap 17 is removed from the cup 1 in FIG. 3. The cap 17 can be made of any suitable material, such as polypropylene, and can be made in any desired color or colors, and may be transparent (as illustrated), translucent, or opaque. It is understood that the cap 17 can be omitted from the cup 1.

As seen in FIG. 2, the illustrated cup 1 includes a handle assembly, indicated generally at 19. The handle assembly 19 has an annular hub 18 and a pair of grips 20 extending outward and downward from the ring. The annular hub 18 is sized and shaped for engaging the shoulder 25 of the container 3. When the annular hub 18 is placed into engagement with the container 3, the annular hub rests on the shoulder 25 of the container and the attachment collar 23 of the container extends upward through the annular ring. The grips 20 of the handle assembly 19 are adapted for grasping by the user of the cup. It is contemplated that the handle assembly can include a single grip or can be omitted from the cup altogether. It is also contemplated that the handle assembly can be formed integral with the container 3.

Figure 11:
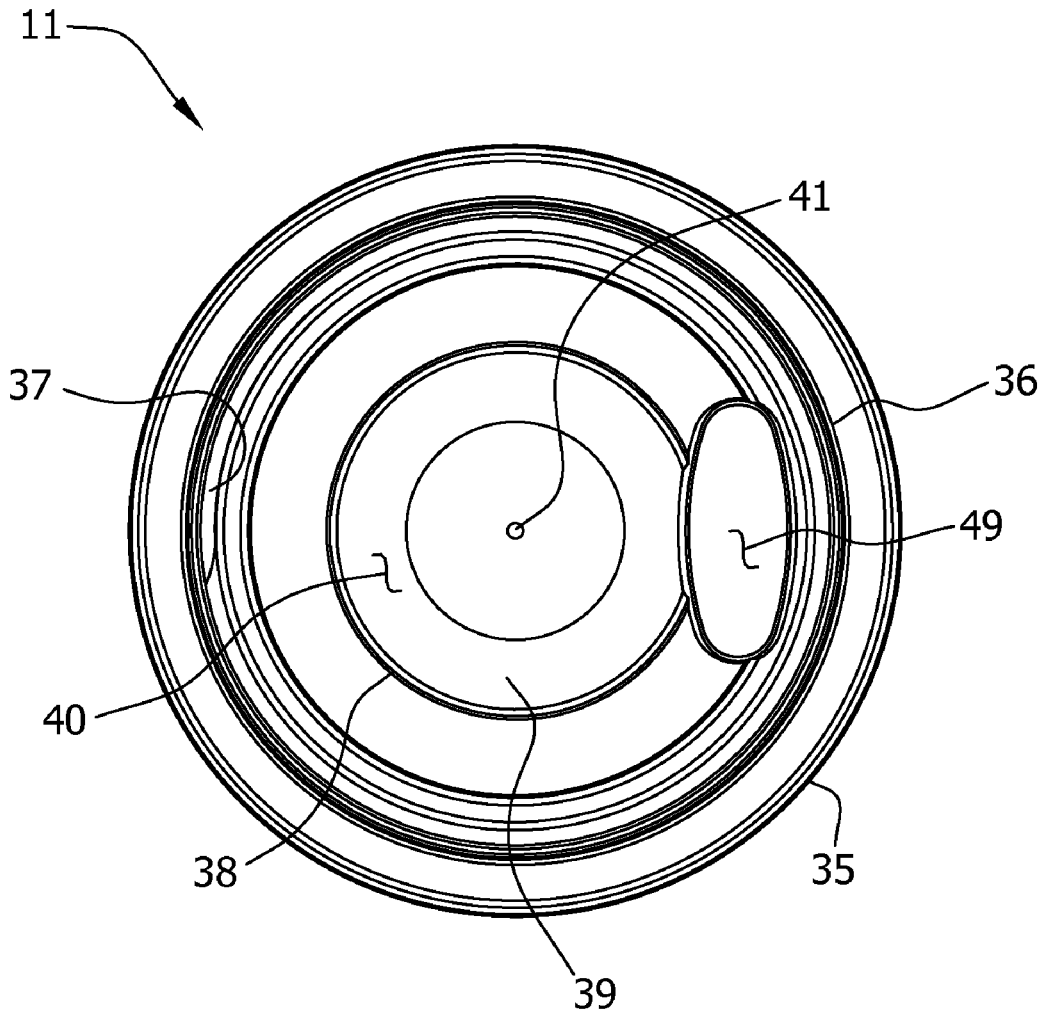
FIG. 11 is a bottom plan of the cover.

With reference now to FIGS. 8-11, the cover 11 of the lid assembly 9 includes a domed, upper portion 39 and a peripheral skirt 35 depending from the upper portion. The upper portion 39 includes a relatively small, generally circular aperture 41 in its center and a relatively larger generally oblong or elliptical opening 49 spaced from the central aperture and adjacent the peripheral skirt 35. As illustrated in FIG. 11, the cover 11 has an inner socket 36 with internal threads 37 for releasably mating with the external threads 27 of the attachment collar 23 of the container 3. The inner socket 36 is spaced transversely inward from the peripheral skirt 35. The cover 11 also includes an interior rib 38 extending downward from an inner surface of the domed, upper portion 39. The interior rib 38 defines the outer boundary of a recess 40 formed in the interior surface of the domed, upper portion 39 of the cover 11.

As illustrated in FIGS. 12-15, the diaphragm 15 has a roughly disk-shaped portion 42, an annular rim 44 depending from the disk-shaped portion, and a spout 46 (broadly, a "liquid discharge member") projecting up from the disk-shaped portion adjacent the annular rim. The spout 46 is sized and shaped for projecting up through the elliptical opening 49 in the cover 11 when the cover and diaphragm 15 are assembled. The spout 46 includes a circumscribing rib 48 for cooperating with a part of the disk-shaped portion 42 of the diaphragm 15 to capture a portion of the cover 11 adjacent the elliptical opening 49 therein (see, e.g., FIG. 4). The spout 46 includes a passageway 47 and an opening 45 for allowing liquid to exit or discharge the drinking cup 1. It is understood that the liquid discharge member can be other than a spout, e.g., an elliptical opening similar to the elliptical opening 49 in the cover 11.

Figure 4:
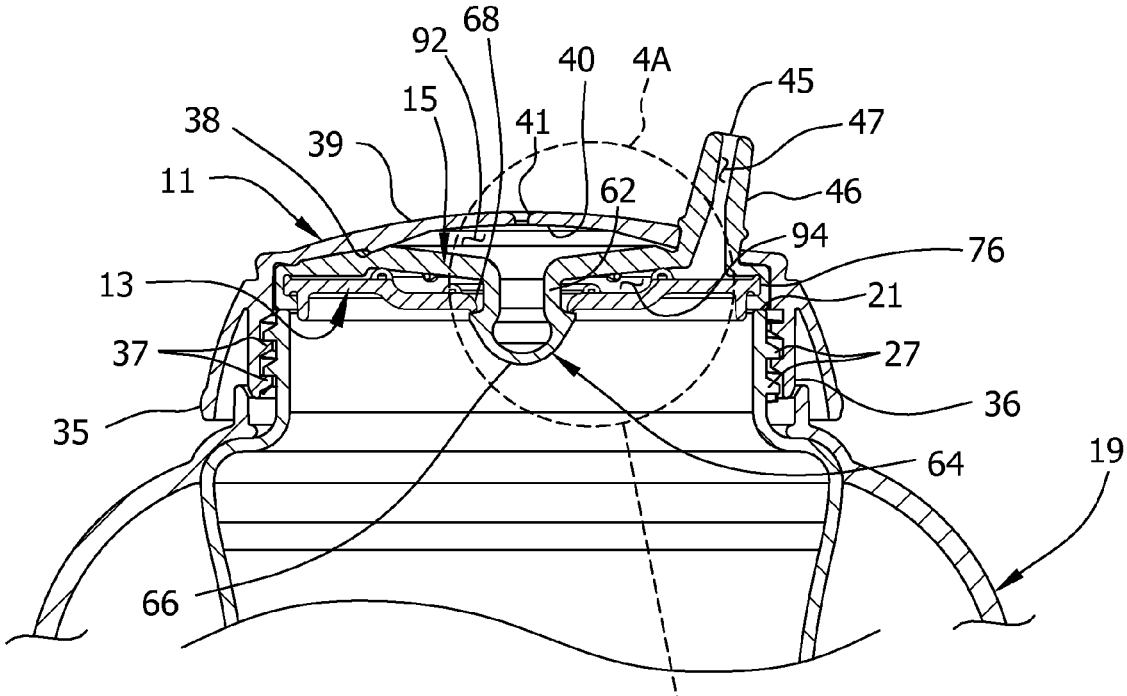
FIG. 4 is an enlarged, fragmentary vertical cross-section of the cup illustrating a diaphragm thereof in a sealed position.
Figure 12:
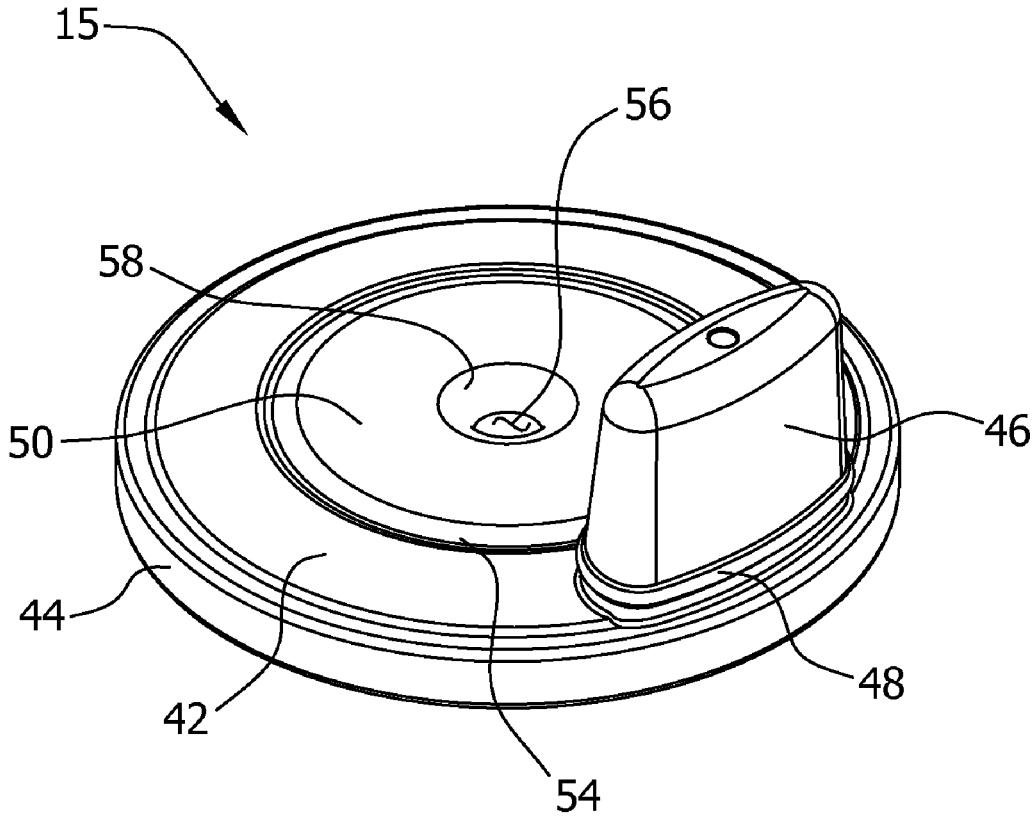
FIG. 12 is a perspective of the diaphragm.
Figure 14:
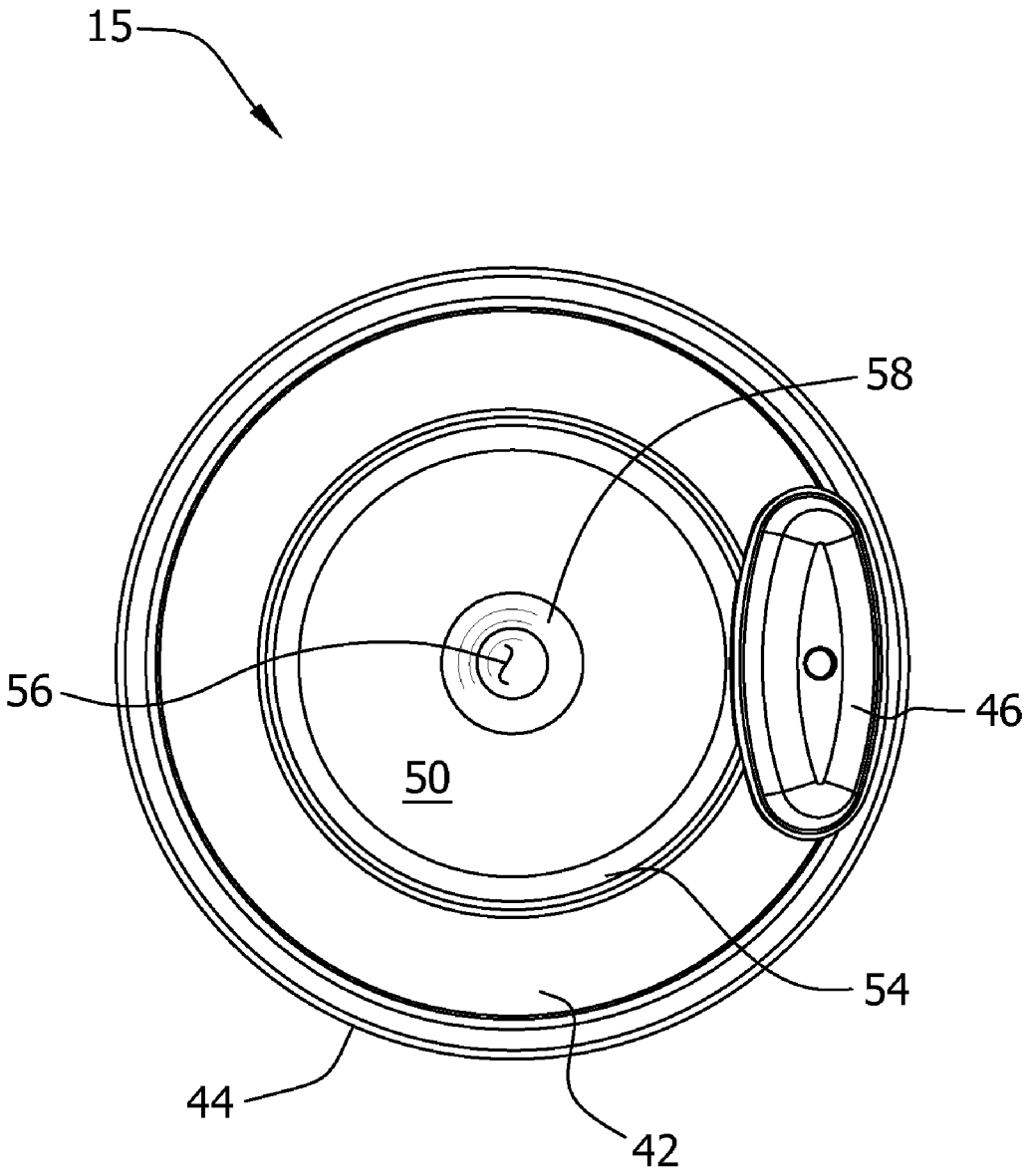
FIG. 14 is a top plan of the diaphragm.
Figure 15:
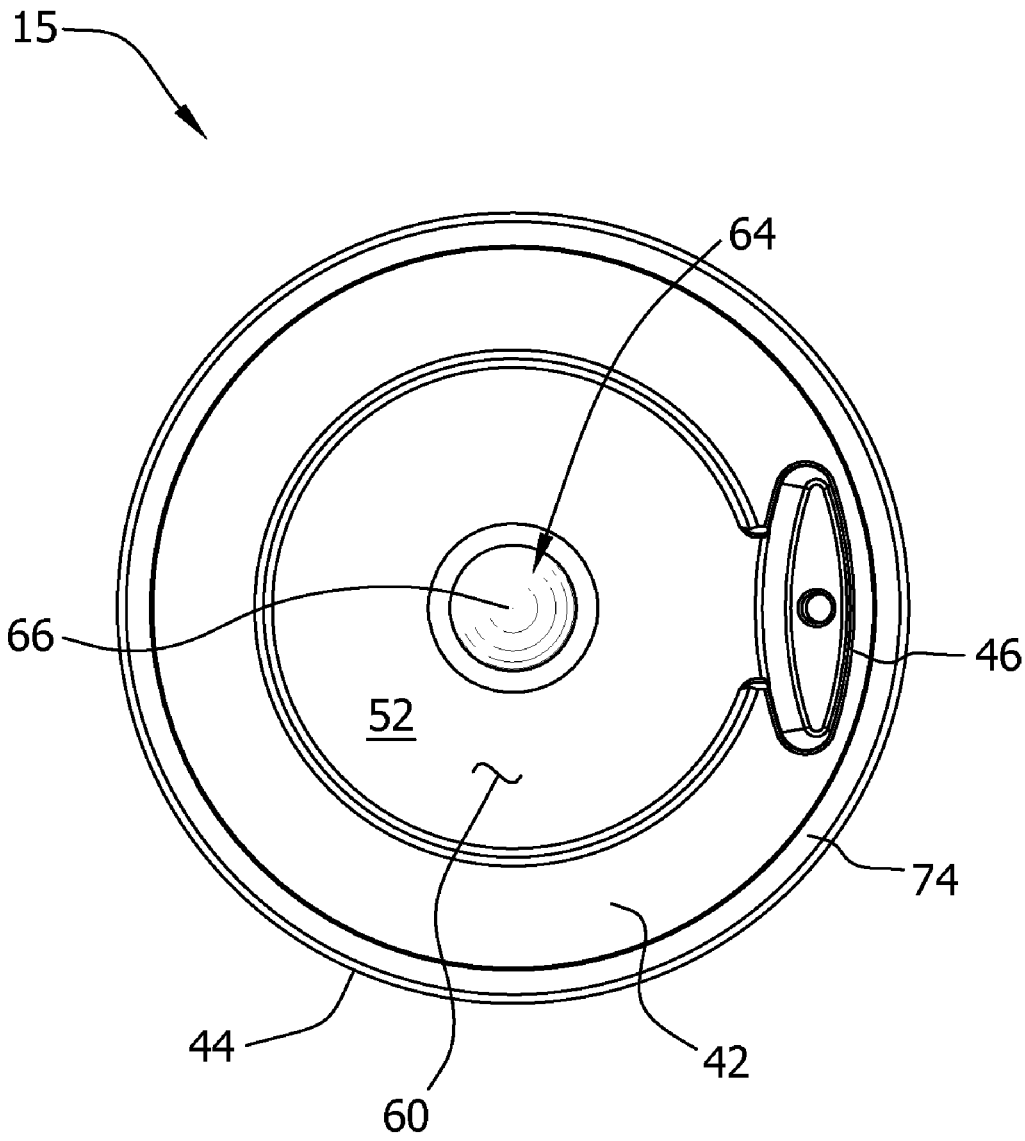
FIG. 15 is a bottom plan of the diaphragm.
Figure 16:
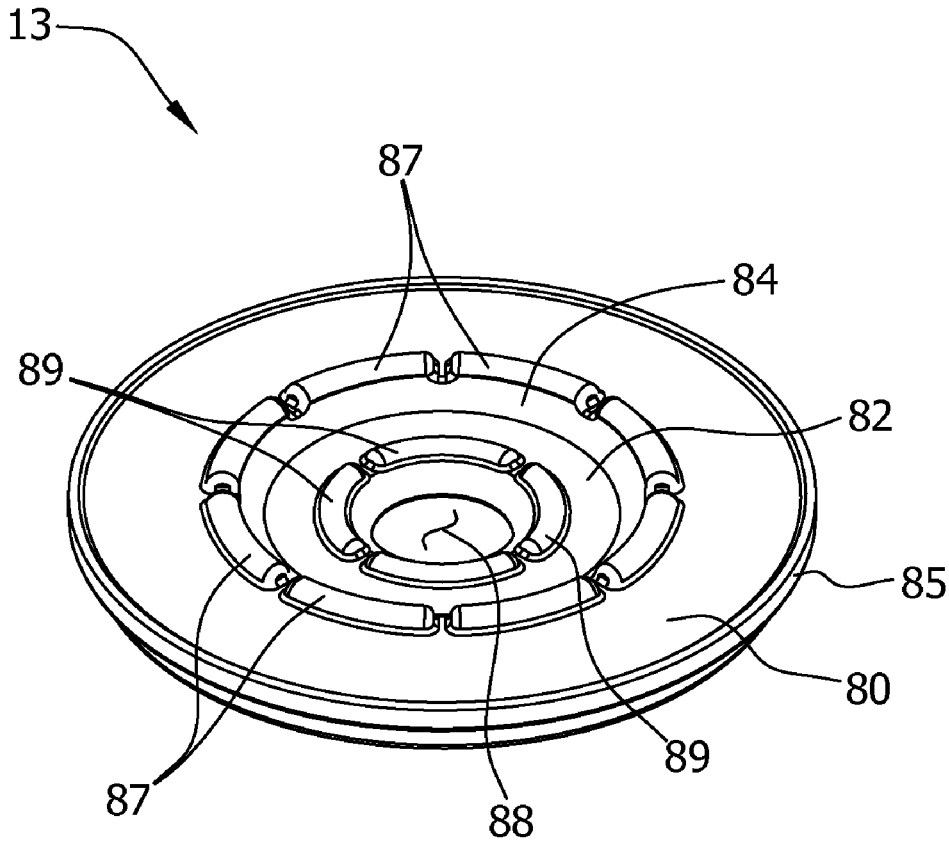
FIG. 16 is a perspective of a closure member.
Figure 17:
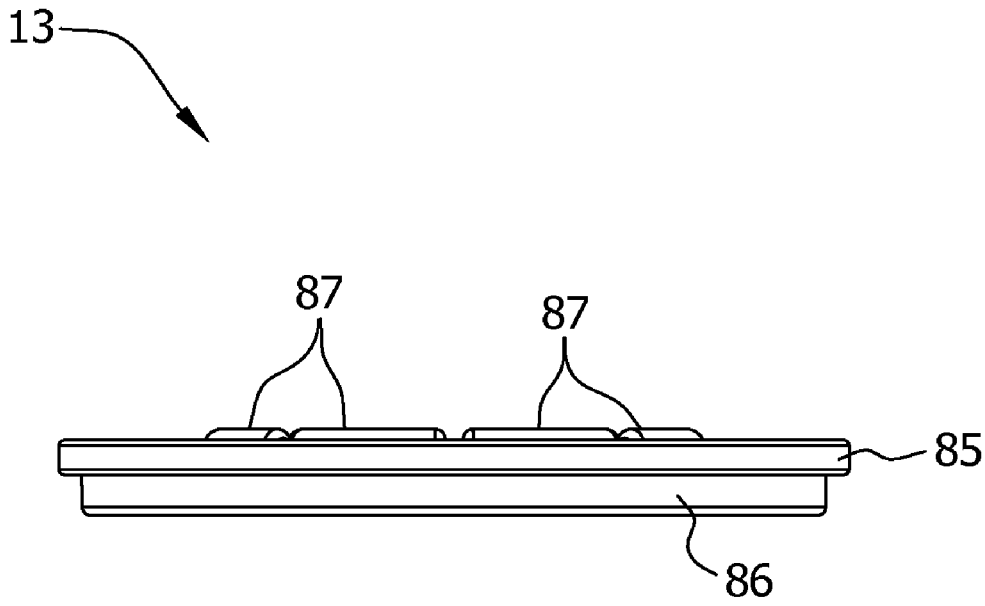
FIG. 17 is a side elevation of the closure member.
Figure 18:
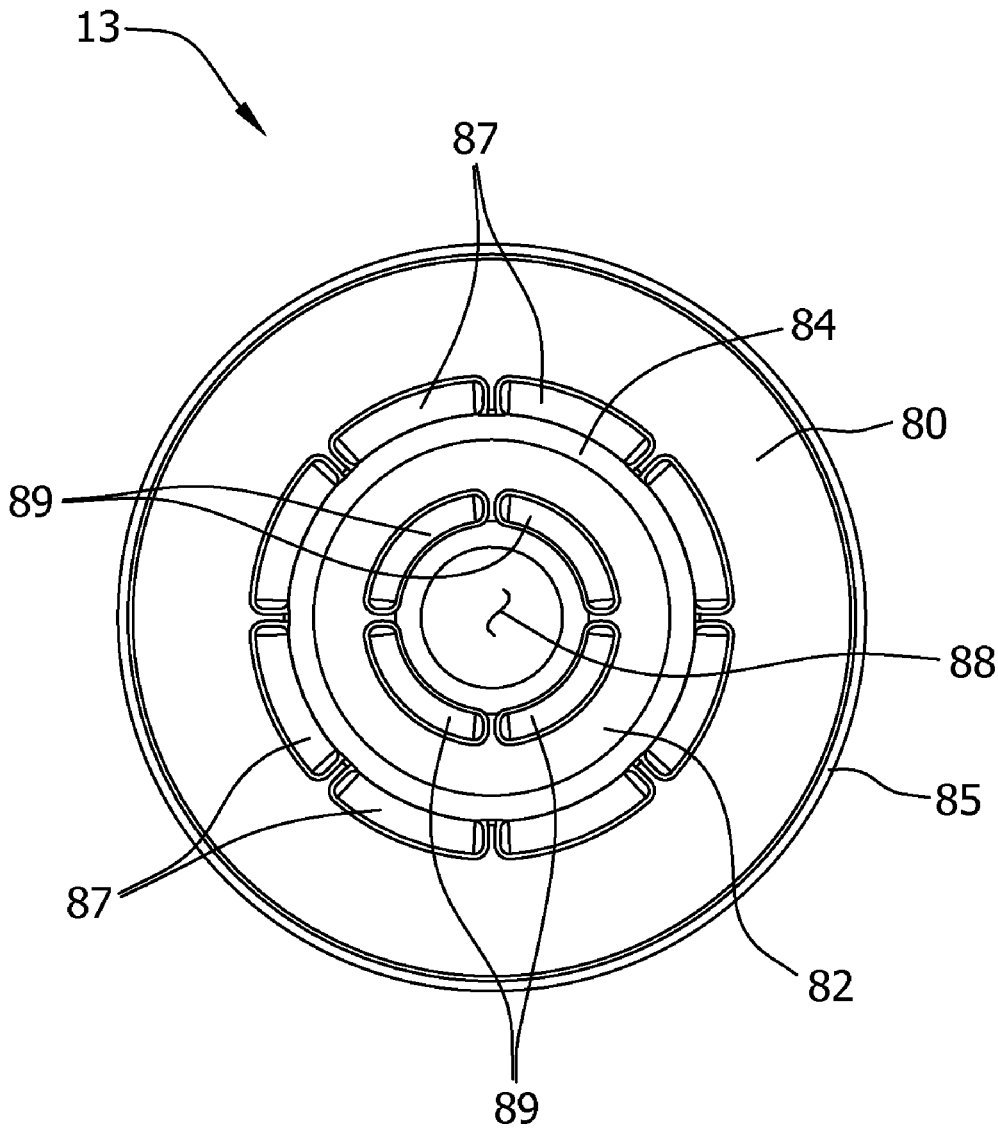
FIG. 18 is a top plan of the closure member.
Figure 19:
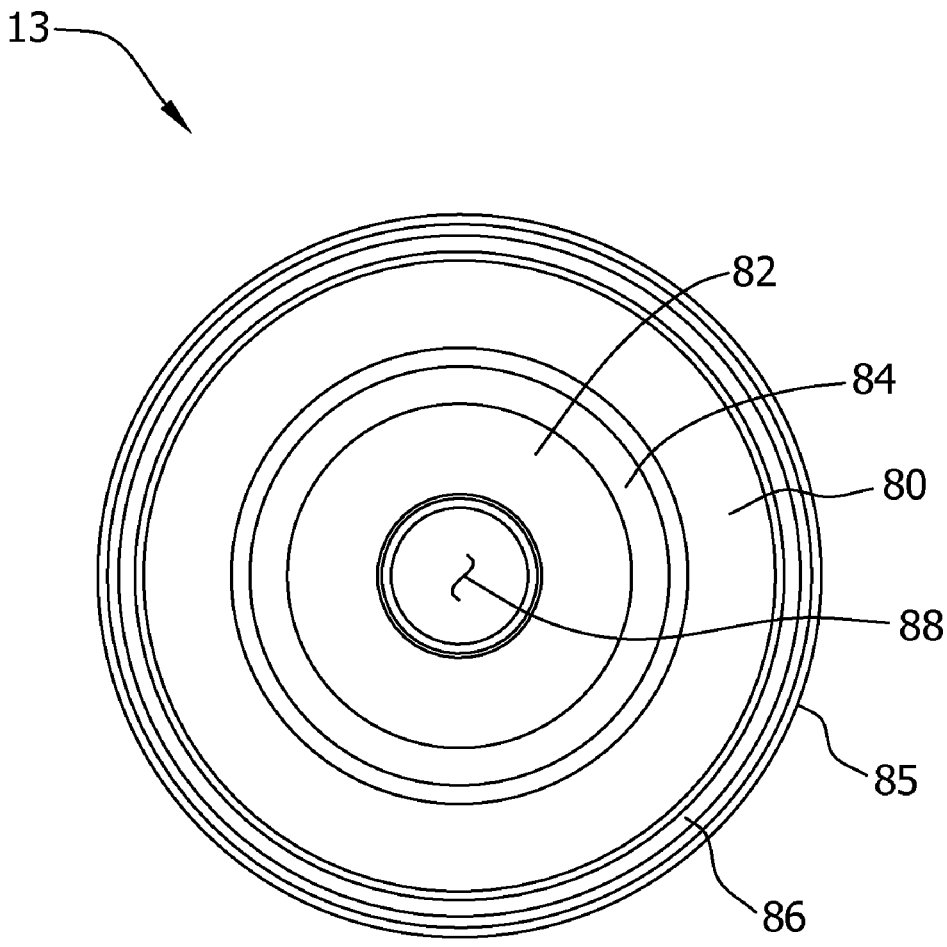
FIG. 19 is a bottom plan of the closure member.

The disk-shaped portion 42 of the diaphragm 15 has an upper surface 50 (FIG. 14) and a lower surface 52 (FIG. 15). As seen in FIGS. 12 and 14, the upper surface 50 includes an annular tapered groove 54, a central aperture 56, and a sloped wall 58 adjacent to and sloping towards the central aperture. The lower surface 52 of the disk-shaped portion 42 includes a recessed center 60 that is in fluid communication with the spout 46 (FIG. 15). With particular reference to FIG. 4, a tubular stem 62 has a generally mushroom shaped tip 64 that depends from the recessed center 60 of the disk-shaped portion 42 of the diaphragm 15. The tubular stem 62 and the tip 64 collectively defining a sealing member of the diaphragm 15. The tip 64 includes a hollow dome 66 and is sized in cross-section larger than the stem 62 to form an annular shoulder 68 adjacent the stem. In one embodiment (not shown), the hollow dome 66 of the tip 64 can include a slit to provide a one-way valve to relieve (e.g., vent) excessive vacuum inside the container 3.

Figure 13:
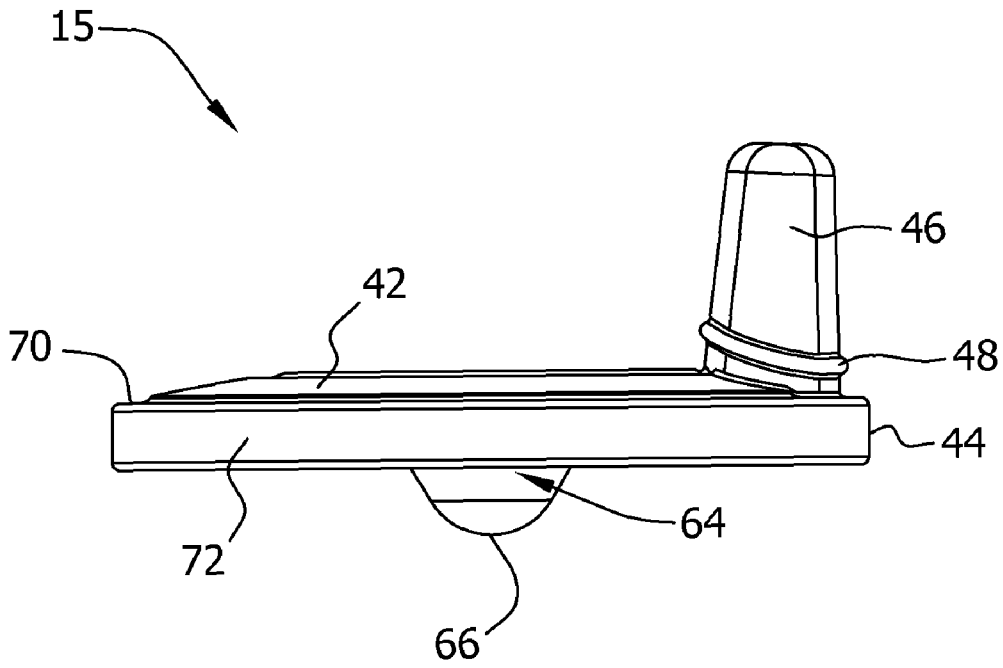
FIG. 13 is a side elevation of the diaphragm.

As illustrated in FIGS. 13 and 15, the annular rim 44 depends from the lower surface 52 of the diaphragm 15 and includes a generally planar ring-shaped upper member 70, a vertical wall member 72 extending downward from the upper member, and a lower member 74 extending inward from the vertical wall member and spaced from the upper member. The upper member 70, vertical wall member 72, and lower member 74, cooperatively define a channel 76, which is illustrated in FIG. 4. In the illustrated embodiment, the diaphragm 15 is formed as one-piece but it is contemplated that any part, including the tip 64, the disk-shaped portion 42, the annular rim 44, the spout 46, and/or portions thereof can be formed as separate pieces.

Referring to FIGS. 16-19, the closure member 13 of the lid assembly 9 comprises an upper base member 80, a lower base member 82, and a tapered member 84 extending between the upper and lower base members. The tapered member 84 slopes from the upper base member 80 to the lower base member 82. The upper base member 80 has a mounting band 85 extending about the circumference of the upper base member. The mounting band 85 extends above and below the upper base member 80. In other words, the mounting band 85 has a height that is greater than the thickness of the upper base member 80. An annular rib 86 is spaced inward from the mounting band 85 and extends downward from the upper base member 80. It is contemplated, however, that the annular rib 86 can be omitted. It is also contemplated that the closure member 13 can be generally flat with the upper and lower base members 80, 82 being generally in the same plane and the tapered member 84 being omitted.

A plurality of spaced, elongate upper protuberances 87 are disposed on the upper base member 80 adjacent the tapered member 84. The illustrated embodiment includes eight upper protuberances 87 but it is understood that more or fewer upper protuberances can be provided. The lower base member 82 includes a central opening 88 and a plurality of spaced, elongate lower protuberances 89 disposed adjacent the central opening. The illustrated embodiment includes four lower protuberances 89 but it is understood that more or fewer lower protuberances can be provided. It is contemplated that protuberances can be provided on the diaphragm 15 instead of or in addition to the upper and lower protuberances 87, 89 provided on the closure member 13.

The illustrated drinking cup 1 can be repeatedly taken apart for thorough cleaning and reassembled for the next use. The separable components (as seen in FIG. 2) are all relatively large so that they are easy to handle, are not easily lost, and do not pose a danger to small children. In addition, the number of separable components is minimized to make assembly and reassembly of the cup 1 relatively easy without comprising the ability to clean each of the components. As mentioned above, the cap 17 can be easily removed from or secured to the drinking cup 1 via its snap-fit connection with the cover 11. The cover 11, in the illustrated embodiment, can be removed from or secured to the container 3 via its threaded connection therewith. That is, the internal threads 37 of the inner socket 36 of the cover 11 can be engaged with and disengaged from the external threads 27 on the attachment collar 23 of the container 3. Other forms and structures for making a releasable connection between the cover 11 and the container 3 may be used. For instance, the cover 11 may have a snap-fit connection with the container 3. The closure member 13, diaphragm 15, and handle assembly 19 are captured between the cover 11 and the container 3 when the cover is screwed onto (or otherwise attached to) the container. Thus, all of the components of the cup 1 can be easily separated, cleaned and reassembled.

The diaphragm 15 can be snapped onto and off of the closure member 13. More particularly, the diaphragm 15 can be releasably coupled to the closure member 13 by inserting the mounting band 85 of the closure member into the channel 76 of the diaphragm and inserting the mushroom-shaped tip 64 through the central opening 88 in the closure member. The lower member 74 of the annular rim 44 of the diaphragm 15 sealing bears against the upper edge 21 of the container 3 when then the cover is screwed onto the container. The spout 46 of the diaphragm 15 extends up through the elliptical opening 49 in the cover 11. The circumscribing rib 48 extending circumferentially about the spout 46 cooperates with part of the disk-shaped portion 42 to capture a portion of the cover 11 that is adjacent the opening 49. The interior rib 38 of the cover 11 is received in the tapered groove 54 of the diaphragm 15.

As seen in FIG. 4, the cover 11 and diaphragm 15 cooperatively define a first interior chamber 92 (broadly, a "vent chamber"). More specifically, the recess 40 in the domed, upper portion 39 of the cover 11, the upper surface 50 of the disk-shaped portion 42 of the diaphragm 15, the tubular stem 62, and the hollow dome 66 of the tip 64 cooperate to define the first interior chamber 92. The first interior chamber 92 is in fluid communication with the aperture 41 in the cover 11 and therefore is maintained generally at atmospheric pressure. A second interior chamber 94 (broadly, a "vacuum chamber") is defined between the closure member 13 and the diaphragm 15. Specifically, the lower surface 52 and recessed center 60 of the diaphragm 15 and the lower base member 82 and tapered member 84 of the closure member 13 cooperatively define the second interior chamber 94. A portion of the diaphragm 15 is in contact with the upper base member 80 of closure member 13 to minimize the volume of the second interior chamber 94. This facilitates faster priming of the cup 1 during use by minimizing the amount of air that needs to be removed from the second interior chamber 94 before the diaphragm is moved to its unsealed position and thereby allows liquid flow to begin.

Figure 4A:
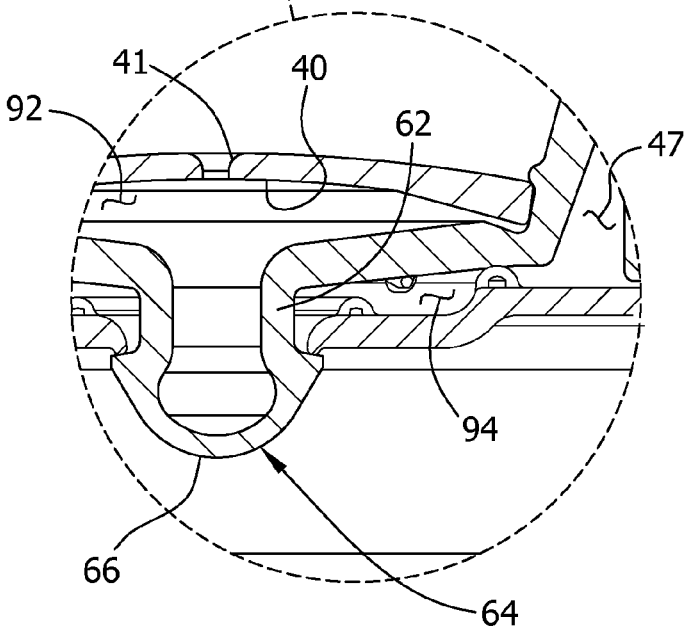
FIG. 4A is an enlargement of the encircled portion of FIG. 4.
Figure 5:
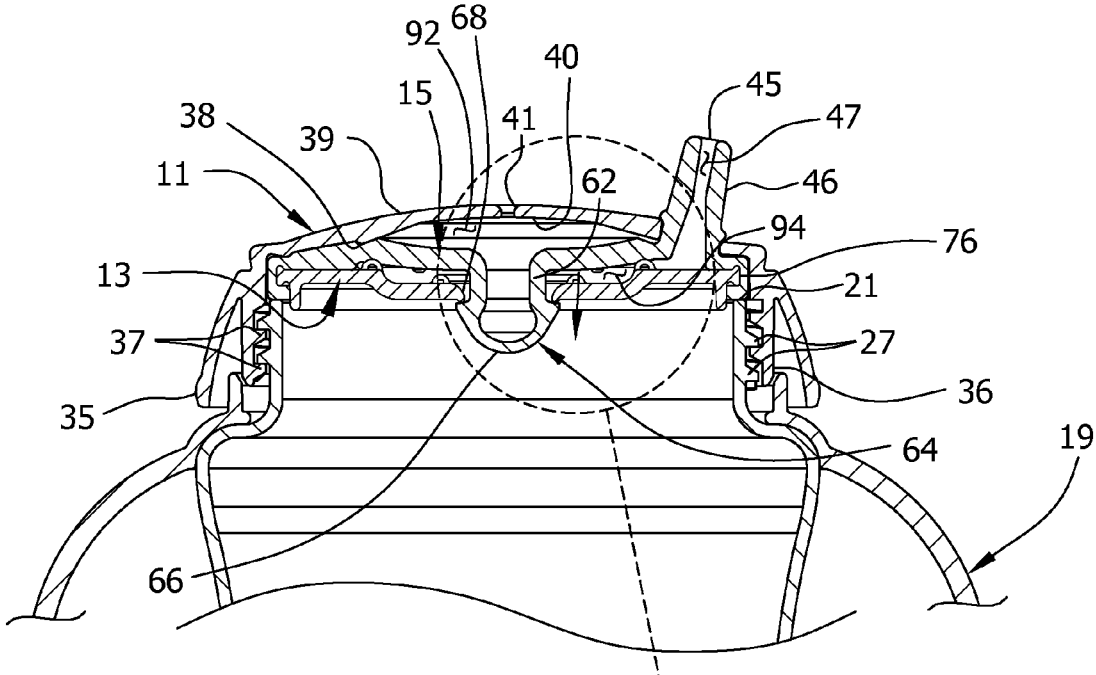
FIG. 5 is an enlarged, fragmentary vertical cross-section of the cup illustrating a portion of the diaphragm being deflected downward but still in its sealed position.
Figure 5A:
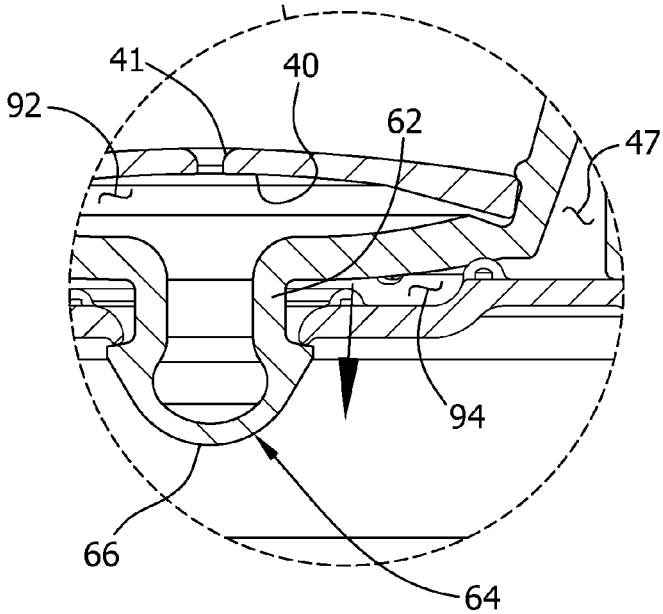
FIG. 5A is an enlargement of the encircled portion of FIG. 5.
Figure 6:
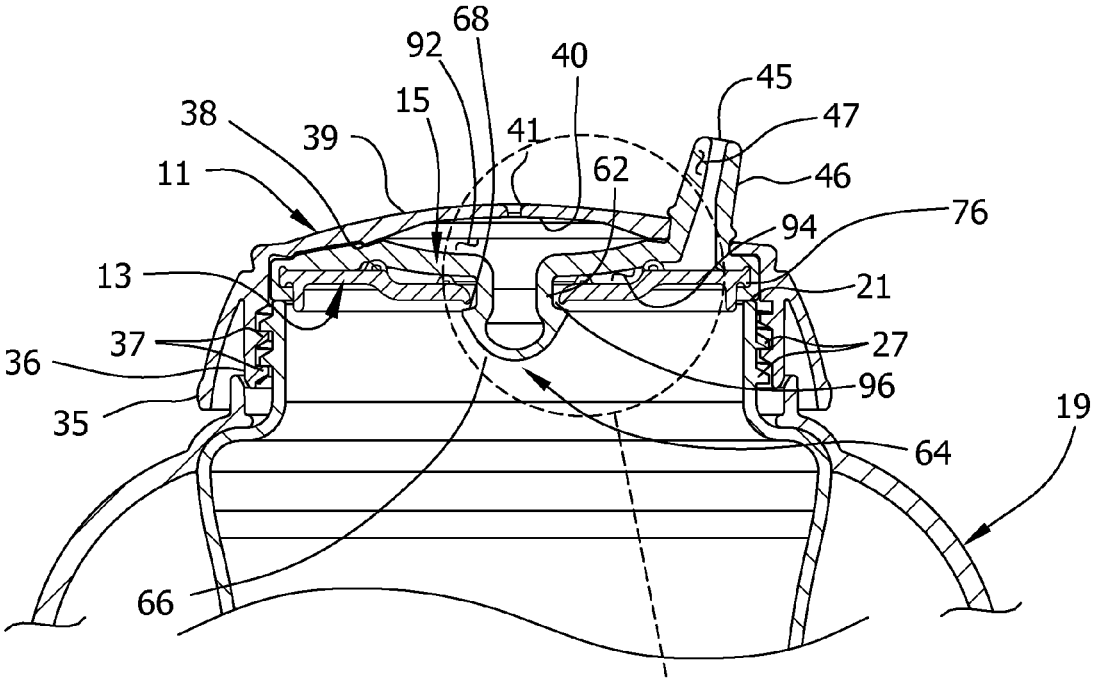
FIG. 6 is an enlarged, fragmentary vertical cross-section similar to FIG. 4 but illustrating the diaphragm in an unsealed position.
Figure 6A:
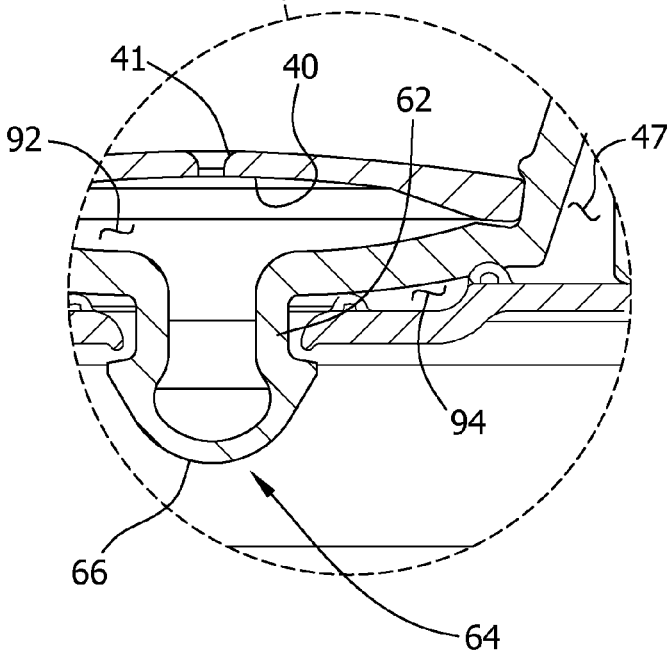
FIG. 6A is an enlargement of the encircled portion of FIG. 6.

Referring now to FIGS. 4-7A, it is easy for a small child to get a drink out of the drinking cup 1 by placing her lips around the spout 46 so as to form a seal with the spout, tilting the cup so that liquid in the container 3 flows into contact with the lid assembly, and sucking on the spout. Sucking on the spout 46 removes some of the air from the second interior chamber 94 of the cup 1, vacuum is thus drawn on the second interior chamber 94, causing the diaphragm 15 to move from a sealed position (FIGS. 4 and 4A) to an unsealed position (FIGS. 6 and 6A). More specifically, the vacuum causes the upper surface 50 of the disk-shaped portion 42 of the diaphragm 15 to flex downward relative to the closure member 13 thereby decreasing the volume of the second interior chamber 94 from a first volume (FIGS. 4 and 4A) to a second, lesser volume (FIGS. 5 and 5A).

The upper protuberances 87 of the closure member 13 act as a fulcrum about which the diaphragm 15 flexes. The upper protuberances 87 also act in cooperation with the interior rib 38 of the cover 11 to define a pinch point for capturing a portion of the diaphragm 15. The lower protuberances 89 of the closure member act as a stop to prevent the diaphragm 15 from engaging and forming a seal with a portion of the closure member about the central opening 88 in the closure member. The spacing between each of the upper protuberances 87 and the spacing between each of the lower protuberances 89 provide pathways for the liquid within the container 3 to flow. The diaphragm 15 is more flexible than the closure member 13. In one suitable embodiment, the diaphragm is elastomeric and has a durometer of about 75 (type A scale).

Continued flexure of the diaphragm 15, as seen in FIGS. 6 and 6A, causes the tubular stem 62 and the mushroom-shaped tip 64 of the diaphragm to move downward relative to the closure member 13. As a result, the annular shoulder 68 of the tip 64 moves from a position in sealing contact with the closure member 13 adjacent the central opening 88 (FIGS. 4-5A), which defines the sealed position of the diaphragm 15, to a position wherein the annular shoulder 68 is at least partially spaced from the portion of the closure member 13 adjacent the central opening (FIGS. 6 and 6A), which defines the unsealed position of the diaphragm. With the annular shoulder 68 of the tip 64 spaced from closure member 13, a passageway 96 is formed allowing liquid within the container to flow into the second interior chamber 94 of the cup 1. That is, liquid is permitted to flow past the diaphragm 15, through the central opening 88 in the closure member 13, through the second interior chamber 94 and into the spout 46 for drinking.

The amount of vacuum pressure, which is applied by the user sucking on the spout 46, needed to move the diaphragm 15 between its sealed and unsealed positions can be predetermined by varying the area of the diaphragm (i.e., the annular shoulder 68 of the tip 64) and the area of the closure member 13 that is contacted by the diaphragm. In one embodiment, the amount of vacuum pressure needed to move the diaphragm 15 between its sealed and unsealed position is less than 100 inches of water. In one suitable embodiment, for example, the amount of vacuum pressure needed to move the diaphragm 15 between its sealed and unsealed position is about 47 inches of water.

As liquid is drawn out of the container 3 by the child, liquid fills the reduced volume of the second interior chamber 94 of the cup 1 thereby gradually reducing the vacuum therein. As the vacuum pressure within the second interior chamber 94 approaches equilibrium with the pressure within container 3, the resiliency of the diaphragm 15 causes it to move back to the sealed position. In doing so, the upper surface 50 of the disk-shaped portion 42 of the diaphragm 15 flexes upward about upper protuberances 87 of the closure member 13 thereby conjointly moving the tubular stem 62 and tip 64 upward to the sealed position illustrated in FIG. 4. In this sealed position, the annular shoulder 68 of the tip 64 of the diaphragm 15 sealingly engages the portion of the closure member 13 adjacent the central opening 88 therein in a liquid-tight manner. Moreover, the tubular stem 62 and tip 64 of the diaphragm 15 are biased toward the sealed position by the resiliency of the diaphragm 15.

Figure 7:
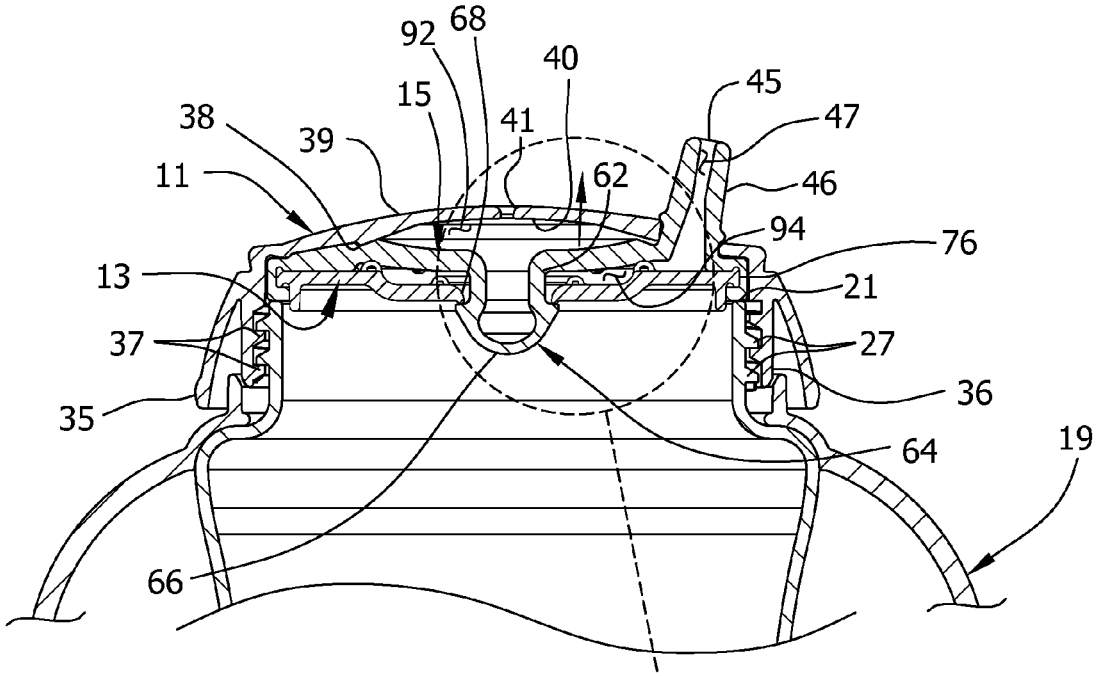
FIG. 7 is an enlarged, fragmentary vertical cross-section of the cup illustrating a diaphragm thereof returned to the sealed position from the unsealed position and a portion deflected downward.
Figure 7A:
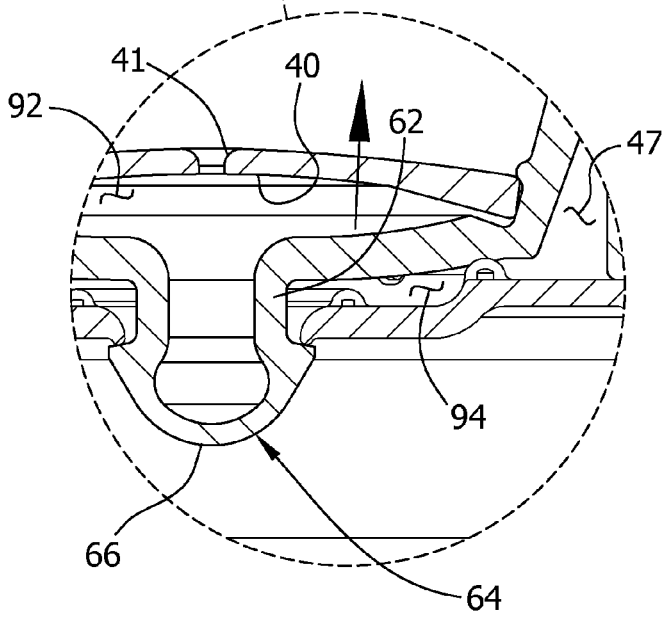
FIG. 7A is an enlargement of the encircled portion of FIG. 7.
Figure 8:
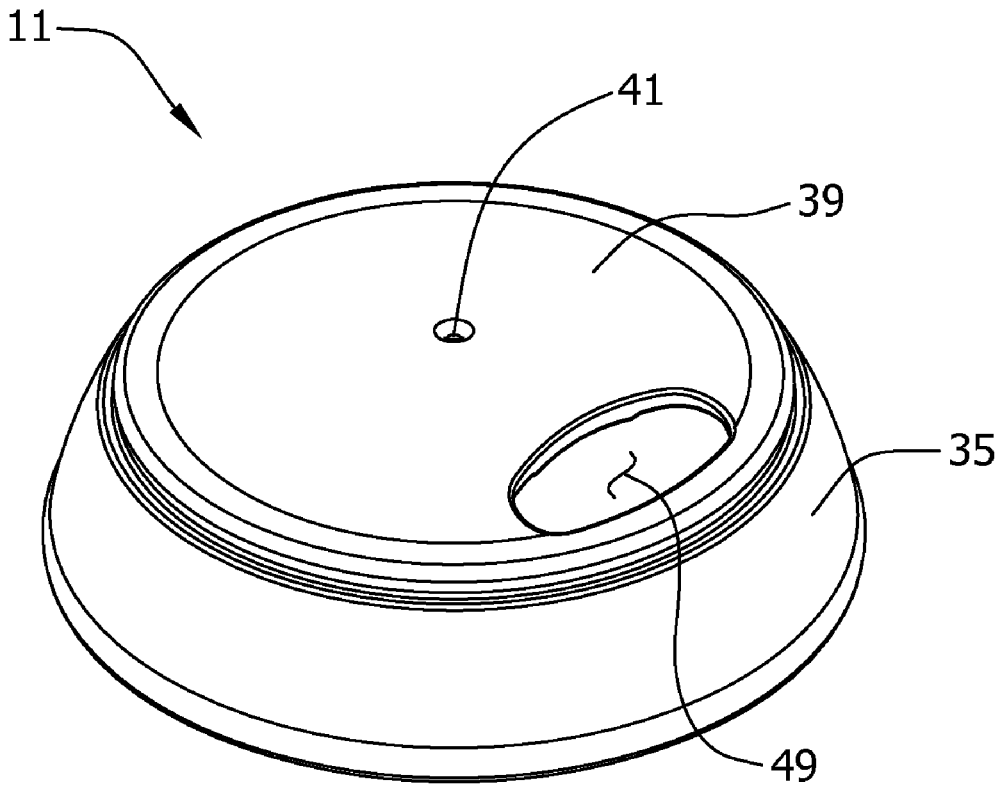
FIG. 8 is a perspective of a cover of the cup.
Figure 9:
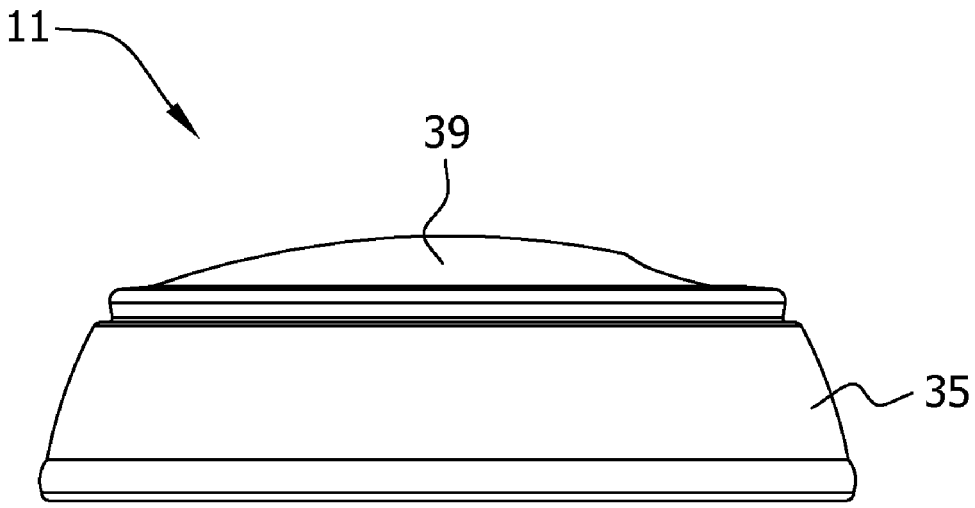
FIG. 9 is a side elevation of the cover.
Figure 10:
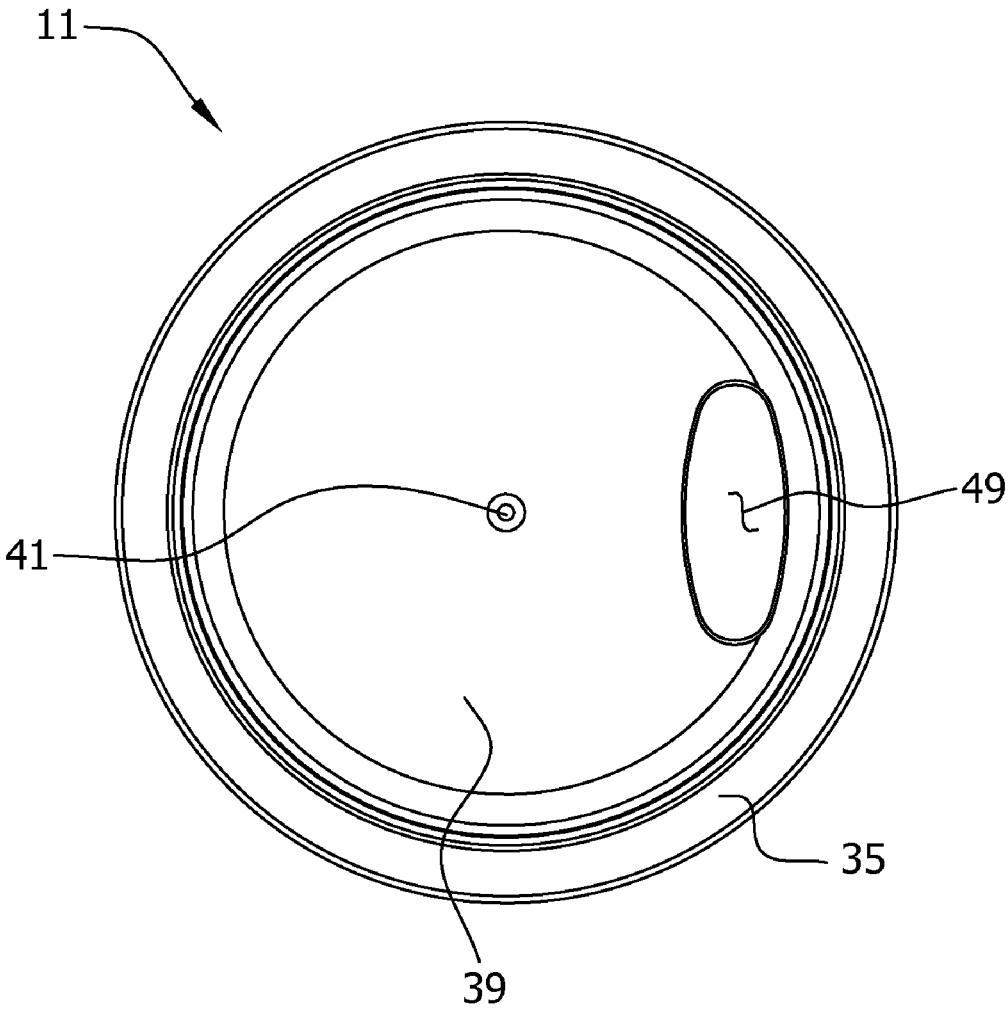
FIG. 10 is a top plan of the cover.

The diaphragm 15, as illustrated in FIGS. 7 and 7A, continues to flex upward (i.e., away from the container 3) even after the diaphragm has returned to its sealed position. As a result, the volume of the second interior chamber 94 increases from the second, lesser volume (FIGS. 7 and 7A) to the first, greater volume (FIGS. 4 and 4A). This increase in volume within the second interior chamber 94 creates a vacuum pressure that draws any residual liquid away from the opening 45 in the spout 46.

In the illustrated embodiment, the sealing member of the diaphragm 15 (i.e., the tubular stem 62 and the tip 64) is generally aligned with a longitudinal axis of the cup 1. It is understood, however, that the sealing member can be spaced from and/or oriented orthogonally with respect to the longitudinal axis of the cup 1 without departing from the scope of this invention.

Figure 20:
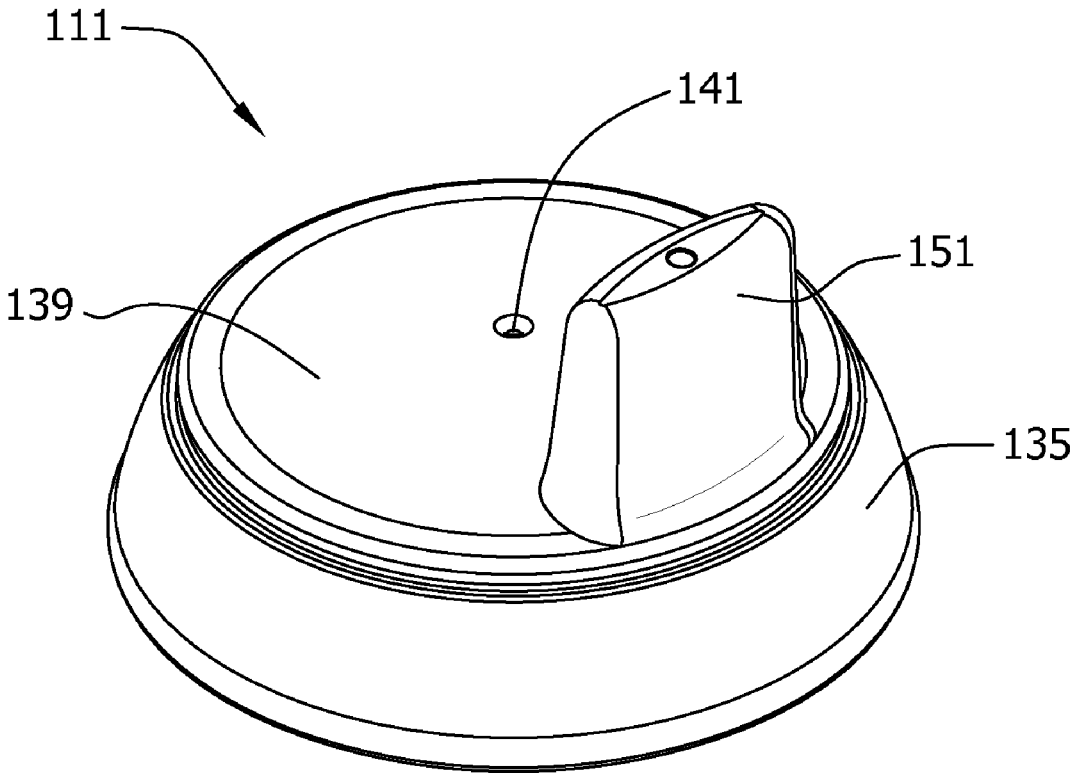
FIG. 20 is a perspective of another embodiment of a cover of the cup.
Figure 22:
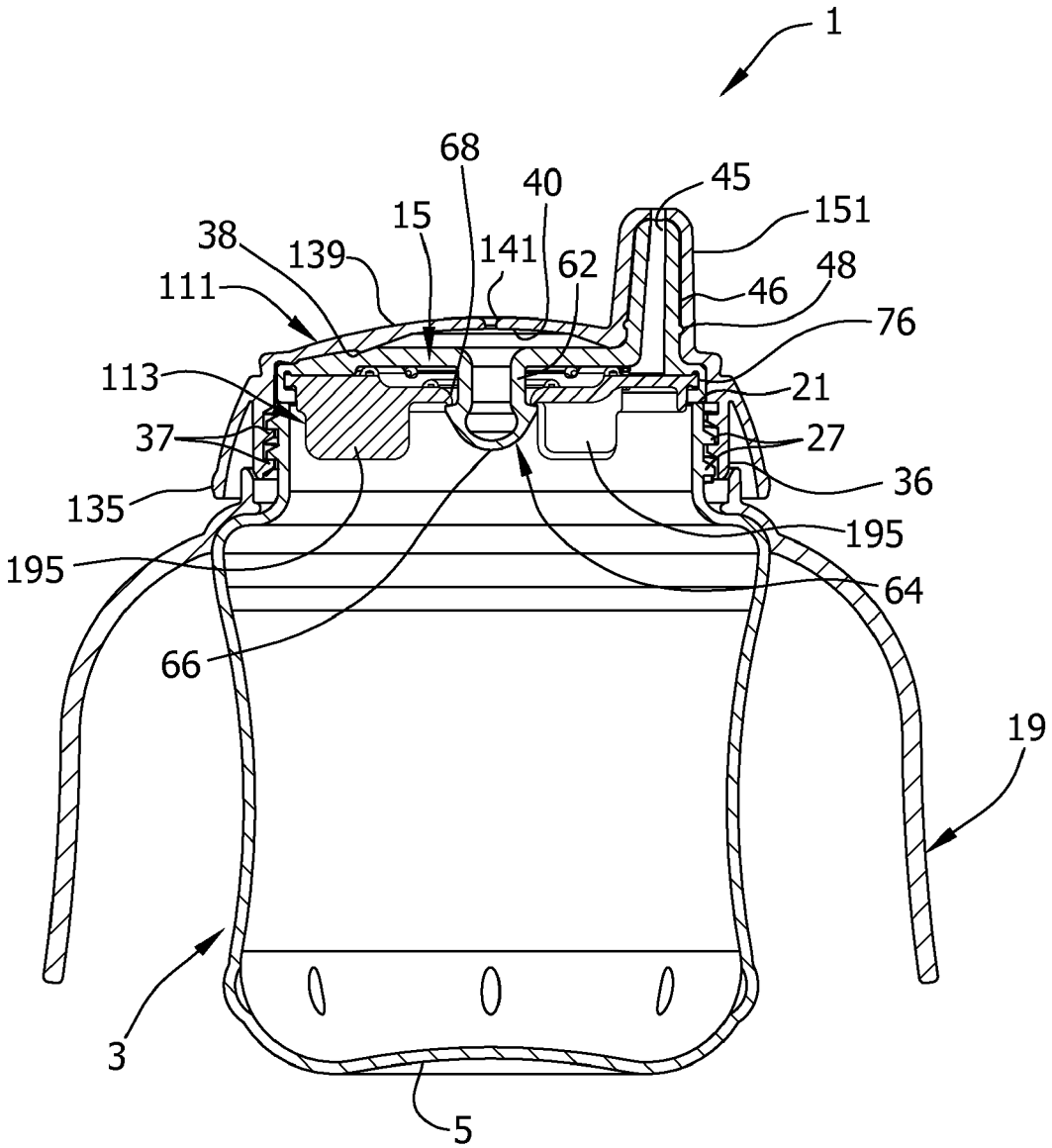
FIG. 22 is a vertical cross-section of the cup having the cover of FIG. 20 and the closure member of FIG. 21.

FIG. 20 is a perspective of another embodiment of a cover 111 of the cup 1. The cover 111 illustrated in FIG. 20 is similar to the cover 11 of FIGS. 1-19 except that the cover of this embodiment includes a spout shield 151 for covering the spout 46 of the diaphragm 15. Thus, the cover 111 includes a domed, upper portion 139 and a peripheral skirt 135 depending from the upper portion. The upper portion 139 includes a relatively small, generally circular aperture 141 in its center. As illustrated in FIG. 22, the spout shield 151 of this embodiment is sized and shaped for receiving the spout 46 of the diaphragm 15 therein, thereby providing a relatively rigid cover for the relatively soft, flexible spout. The circumscribing rib 48 of the spout 46 acts as an o-ring in this embodiment by sealingly engaging the interior surface of the spout shield.

Figure 21:
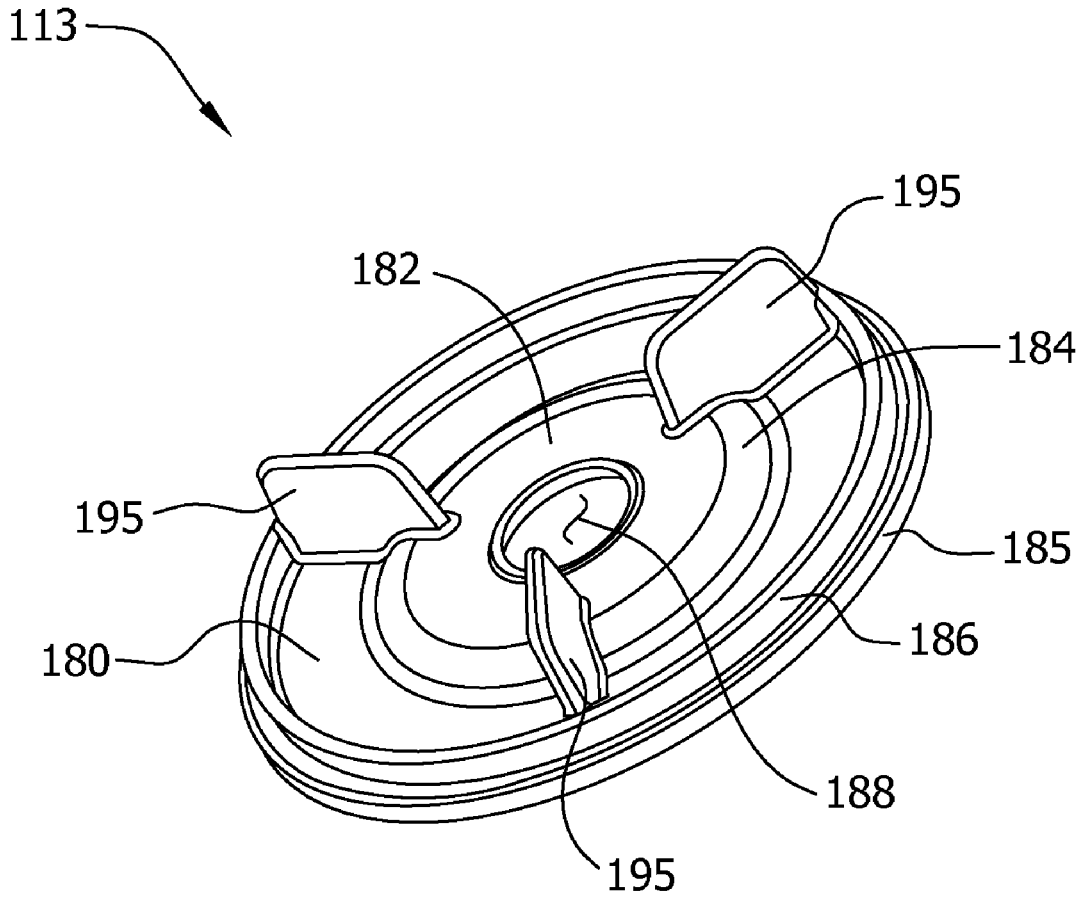
FIG. 21 is a bottom perspective of another embodiment of a closure member of the cup.

FIG. 21 is a bottom perspective of another embodiment of a closure member 113 of the cup 1. As in the previous embodiment of FIGS. 1-19, the closure member 113 of this embodiment includes an upper base member 180, a lower base member 182, and a tapered member 184 extending between the upper and lower base members. The tapered member 184 slopes from the upper base member 180 to the lower base member 182. The upper base member 180 has a mounting band 185 extending about the circumference of the upper base member. The mounting band 185 extends above and below the upper base member 180. In other words, the mounting band 185 has a height that is greater than the thickness of the upper base member 180. An annular rib 186 is spaced inward from the mounting band 185 and extends downward from the upper base member 180. It is contemplated, however, that the annular rib 186 may be omitted. A plurality of spaced, elongate upper protuberances (not shown but similar to the upper protuberances 87 of FIG. 16) are disposed on the upper base member 180 adjacent the tapered member 184. The lower base member 182 includes a central opening 188 and a plurality of spaced, elongate lower protuberances (not shown but similar to the lower protuberances 89 of FIG. 16) disposed adjacent the central opening. The closure member 113 of this embodiment includes three grip tabs 195 depending from the lower surface thereof. These grip tabs 195 provide finger grips to facilitate disassembly of the closure member 113 and the diaphragm 15 from the cover 111. In use, the user can grip one or more of the grip tabs 195 and pull the closure member 113 and diaphragm 15 from engagement with the cover 111. While three grip tabs 195 are illustrated, more or fewer grip tabs 195 can be provided.

FIG. 23 is a vertical cross-section of the cup 1 illustrating another embodiment of a container, indicated generally at 203. In this embodiment, the container 203 is at least partially non-rigid and, as a result, can be flexible and/or collapsible. In suitable embodiments, the non-rigid container 203 can be in the form of a bag (e.g., a foil pouch) or a box (e.g., a juice box). Since the sealed position of diaphragm 15 is in a direction away from the container 203, squeezing of the non-rigid container 203 causes the pressure within the container to increase and, thereby, creates a greater seal between the diaphragm 15 and the closure member 113. Thus, liquids contained within the non-rigid container 203 are held in a leak-tight manner within the container even when the non-rigid container is squeezed. Stated another way, the diaphragm 15 has a first sealing pressure in its sealed position and a second, greater sealing pressure when the non-rigid container 203 is squeezed.

Figure 24:
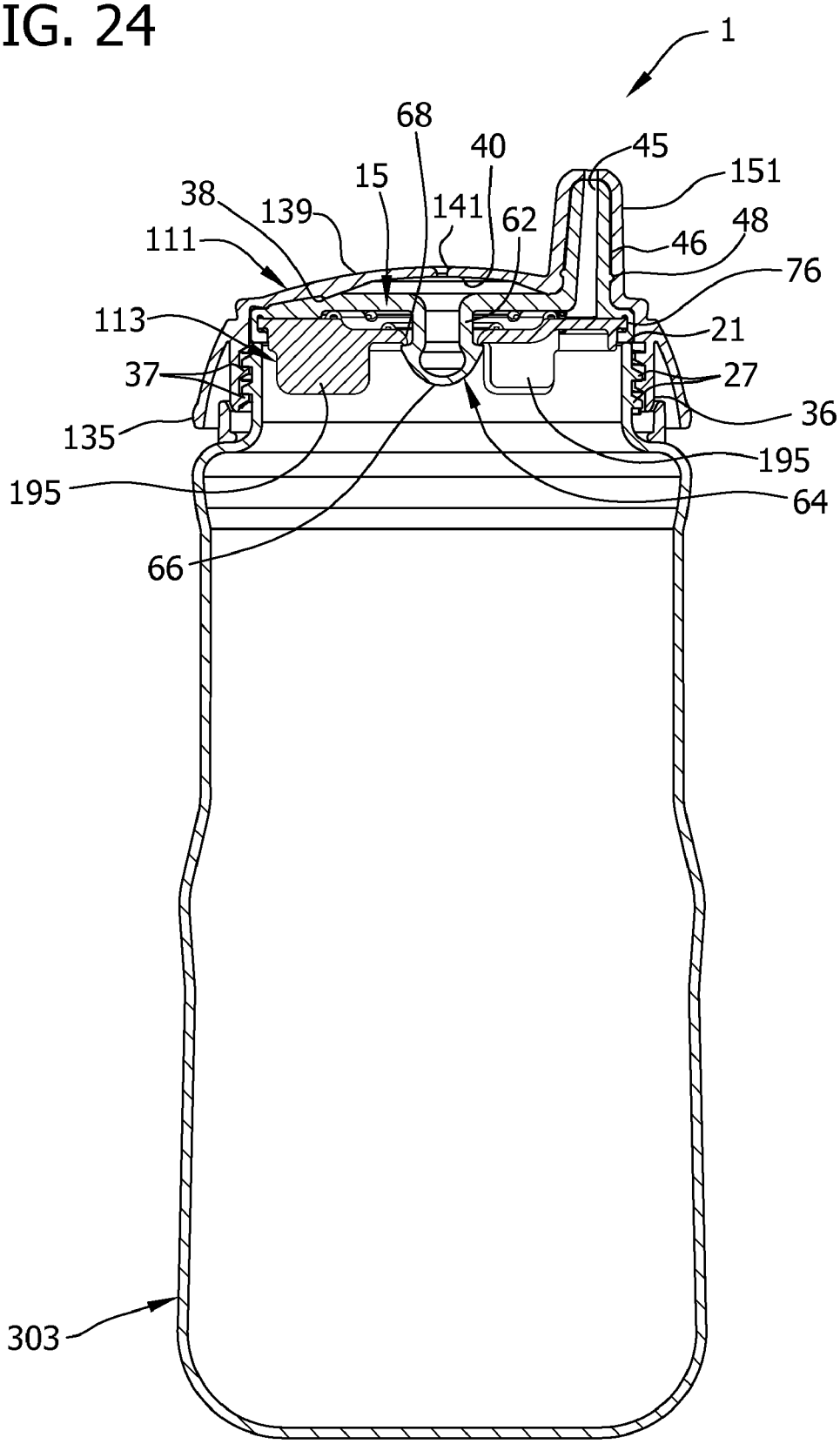
FIG. 24 is a vertical cross-section of a leak resistant drinking cup in the form of a sports bottle.
Figure 25:
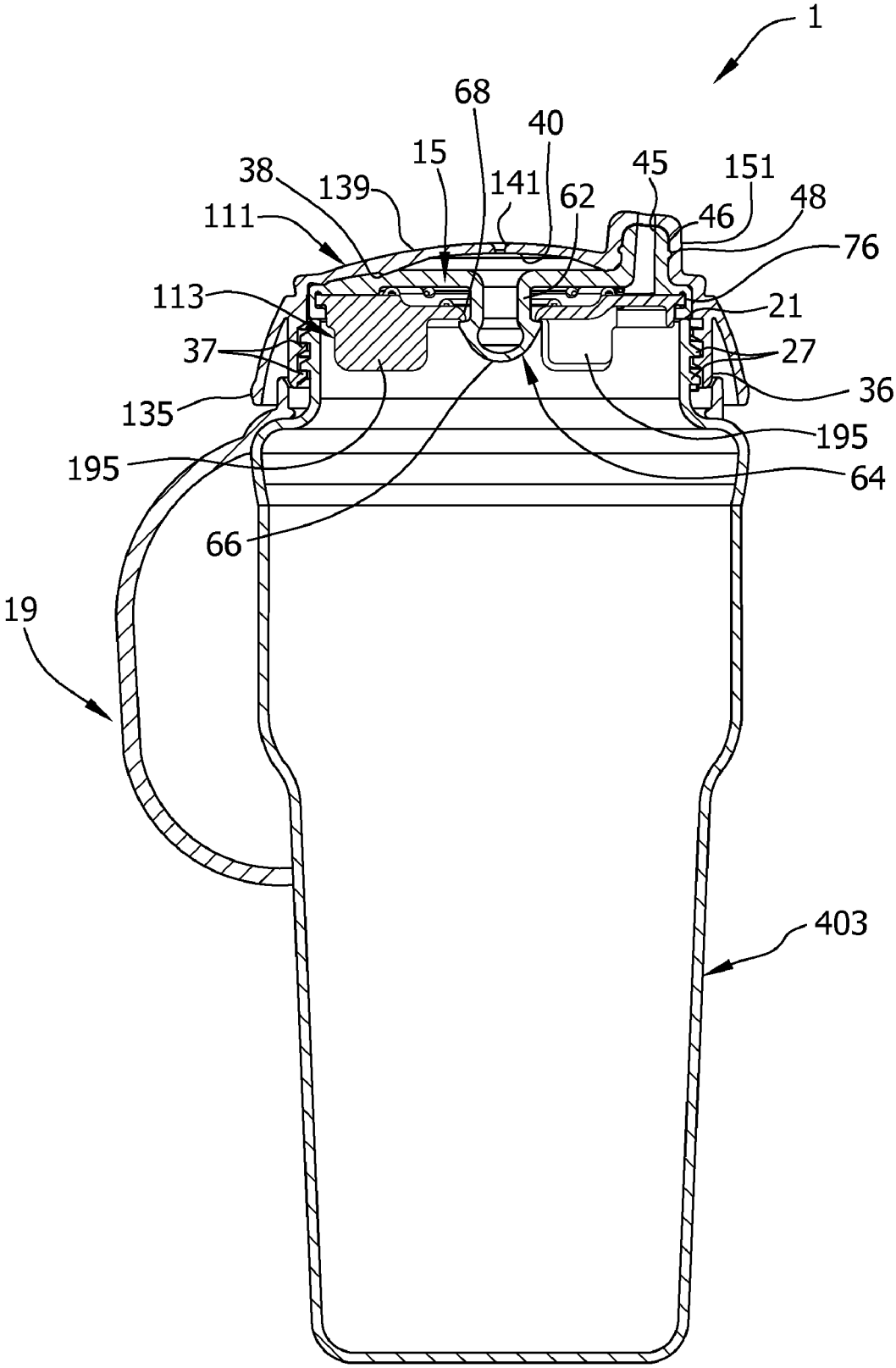
FIG. 25 is a vertical cross-section of a leak resistant drinking cup in the form of a commuter cup.

FIG. 24 is a vertical cross-section of the cup 1 illustrating yet another embodiment of a container, indicated generally at 303. In this embodiment, the container 303 is in the form of a sports bottle. FIG. 25 is a vertical cross-section of the cup 1 illustrating still yet another embodiment of a container, indicated generally at 403. In this embodiment, the container 403 is in the form of a commuter cup. In this embodiment, the spout 46 of the diaphragm 15 and the spout shield 151 of the cover 111 are shorter than in the previously described embodiments.

Figure 26:
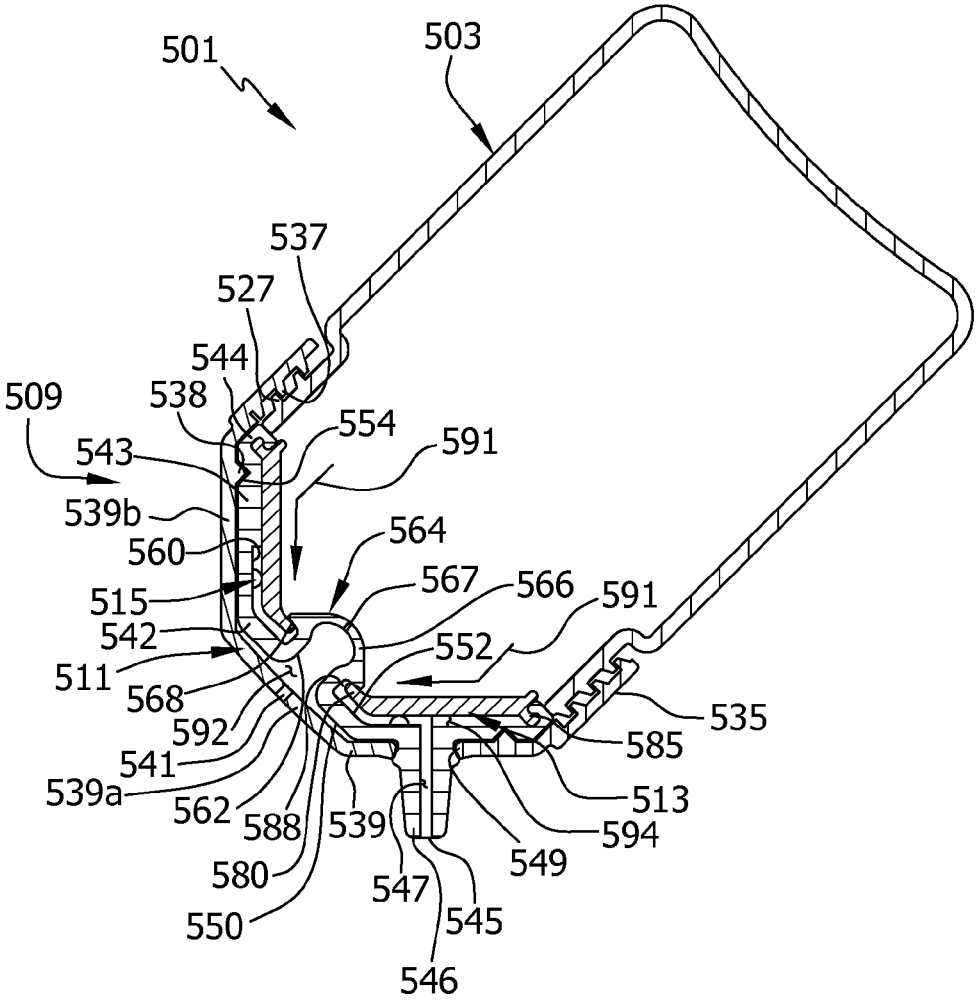
FIG. 26 is a vertical cross-section of another embodiment of a leak resistant drinking cup, the cup being seen in a tilted, drinking position.

Another embodiment of a leak resistant drinking cup, generally indicated at 501, is illustrated in FIG. 26. The cup 501 is illustrated in a tilted, drinking position. The cup 501 includes a container, which is generally indicated at 503, and a generally frustum lid assembly, which is generally indicated at 509. The lid assembly 509 of the cup 501 is adapted for removable attachment to the container 503 for selectively closing the container. The lid assembly 509 comprises a cover 511, a closure member 513, and a diaphragm 515 disposed between the cover and the closure member. A cap (not shown but similar to the cap 17 seen in FIGS. 1 and 2) can be selectively secured to the cover 511 via a snap-fit connection. The cap can be selectively placed on the cover 511 during periods of non-use (e.g., storage, travel) of the cup 501 and removed during periods of use.

The cover 511 of the lid assembly 509 includes an upper portion 539 and a peripheral skirt 535 depending from the upper portion. The upper portion 539 includes a relatively small, generally circular aperture 541 in its center and a relatively larger generally oblong or elliptical opening 549 spaced from the central aperture. The peripheral skirt 535 of the cover 511 has internal threads 537 for releasably mating with external threads 527 of the container 503. The cover 511 also includes an interior rib 538 extending downward from an inner surface of the upper portion 539. The upper portion 539 includes a plateau member **539*a* and a sloped member 539*b* extending between the plateau and the peripheral skirt 535**.

As seen in FIG. 26, the diaphragm 515 has a shape that generally compliments the shape of the cover 511. The diaphragm 515 includes a disk-shaped portion 542, a sloped portion 543 extending from the disk-shaped portion, and an annular rim 544 depending from the disk-shaped portion. A spout 546 (broadly, a "liquid discharge member") projects outward from the sloped portion 543 and is sized and shaped for projecting up through the elliptical opening 549 in the cover 511 when the cover and diaphragm 515 are assembled. The spout 546 includes a passageway 547 and an opening 545 for allowing liquid to exit or discharge the drinking cup 501.

The disk-shaped portion 542 of the diaphragm 515 has an upper surface 550 and a lower surface 552. As seen in FIG. 26, the upper surface 550 includes an annular tapered groove 554 and the lower surface 552 includes a recessed center 560 that is in fluid communication with the spout 546. A tubular stem 562 has a generally mushroom shaped tip 564 that depends from the recessed center 560 of the disk-shaped portion 542 of the diaphragm 515. The tubular stem 562 and the tip 564 collectively defining a sealing member of the diaphragm 515. The tip 564 includes a hollow dome 566 and is sized in cross-section larger than the stem 562 to form an annular shoulder 568 adjacent the stem. The hollow dome 566 of the tip 564 include a slit 567 to provide a one-way valve to relieve (e.g., vent) excessive vacuum inside the container 503.

The closure member 513 of the lid assembly 509 comprises an upper base member 580, a central opening 588 in the upper base member, and a tapered member 584 extending outward from the upper member. The tapered member 584 has a mounting band 585 extending about the circumference of the upper base member. The diaphragm 515 can be releasably coupled to the closure member 513 by joining the mounting band 585 of the closure member to the annular rim 544 of the diaphragm and inserting the mushroom-shaped tip 564 through the central opening 588 in the closure member. The annular rim 544 of the diaphragm 515 sealing bears against an upper edge of the container 503 when then the cover 511 is screwed onto the container. The spout 546 of the diaphragm 515 extends up through the elliptical opening 549 in the cover 511. The interior rib 538 of the cover 511 is received in the tapered groove 554 of the diaphragm 515. The cover 511 and diaphragm 515 cooperatively define a first interior chamber 592 (broadly, a "vent chamber") and a second interior chamber 594 (broadly, a "vacuum chamber") is defined between the closure member 513 and the diaphragm 515.

It is easy for a small child to get a drink out of the drinking cup 501 by placing her lips around the spout 546 so as to form a seal with the spout, tilting the cup (e.g., as seen in FIG. 26) so that liquid in the container 503 flows into contact with the lid assembly, and sucking on the spout. Sucking on the spout 546 removes some of the air from the second interior chamber 594 of the cup 501, vacuum is thus drawn on the second interior chamber 594, causing the diaphragm 515 to move from a sealed position to an unsealed position. In this embodiment, the tapered member 584 of the closure member 513 directs liquid in the container toward the central opening 588 as illustrated by arrows 591. As the volume of liquid within the container 503 is reduced, the tapered member 584 funnels the remaining liquid toward the central opening 588 where it can pass through the closure member 513 and into the second interior chamber 594. From the second interior chamber 594, the liquid can flow freely into the channel 547 in the spout 546 and out the opening 545 therein for consumption by the child using the cup 501.

Figure 27:
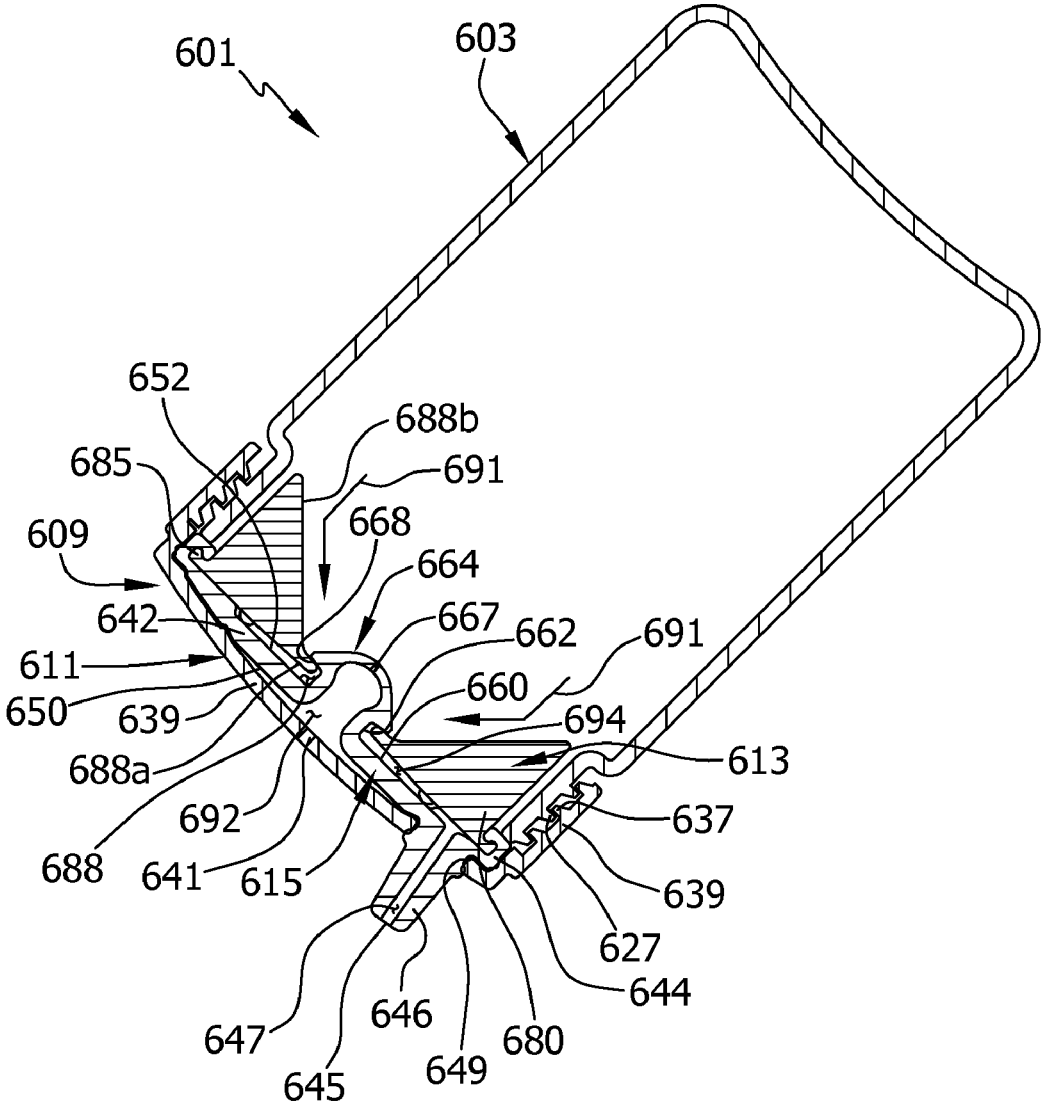
FIG. 27 is a vertical cross-section of yet another embodiment of a leak resistant drinking cup, the cup being seen in a tilted, drinking position.

FIG. 27 illustrates another embodiment of a leak resistant drinking cup, indicated generally at 601, having a container 603 and a lid assembly 609. The cup 601 is illustrated in a tilted, drinking position. The lid assembly 609 comprises a cover 611, a closure member 613, and a diaphragm 615 disposed between the cover and the closure member. The cover 611 includes a domed upper portion 639 and a peripheral skirt 635 depending from the upper portion. The upper portion 639 includes a relatively small, generally circular aperture 641 in its center and a relatively larger generally oblong or elliptical opening 649 spaced from the central aperture. The peripheral skirt 635 of the cover 611 has internal threads 637 for releasably mating with external threads 627 of the container 603.

As seen in FIG. 27, the diaphragm 615 includes a disk-shaped portion 642, an annular rim 644, and a spout 646 (broadly, a "liquid discharge member") projecting outward from the disk-shaped portion. The spout 646 is sized and shaped for projecting up through the elliptical opening 649 in the cover 611 when the cover and diaphragm 615 are assembled. The spout 646 includes a passageway 647 and an opening 645 for allowing liquid to exit or discharge the drinking cup 601.

The disk-shaped portion 642 of the diaphragm 615 has an upper surface 650 and a lower surface 652. As seen in FIG. 26, the lower surface 652 includes a recessed center 660 that is in fluid communication with the spout 646. A tubular stem 662 has a generally mushroom shaped tip 664 that depends from the recessed center 660 of the disk-shaped portion 642 of the diaphragm 615. The tubular stem 662 and the tip 664 collectively defining a sealing member of the diaphragm 615. The tip 664 includes a hollow dome 666 and is sized in cross-section larger than the stem 662 to form an annular shoulder 668 adjacent the stem. The hollow dome 666 of the tip 664 include a slit 667 to provide a one-way valve to relieve (e.g., vent) excessive vacuum inside the container 603.

The closure member 613 of the lid assembly 609 comprises a base member 680 having a central opening 688 therethrough. The base member 680 has a generally planar upper surface 688*a* and a sloped lower surface 688*b*. The lower surface 688*b* is sloped toward the central opening 688 in the closure member 613. The base member 680 has a mounting band 685 extending about the circumference of the upper base member. The diaphragm 615 can be releasably coupled to the closure member 613 by joining the mounting band 685 of the closure member to the annular rim 644 of the diaphragm and inserting the mushroom-shaped tip 664 through the central opening 688 in the closure member. The annular rim 644 of the diaphragm 615 sealing bears against an upper edge of the container 603 when then the cover 611 is screwed onto the container. The spout 646 of the diaphragm 615 extends up through the elliptical opening 649 in the cover 611. The cover 611 and diaphragm 615 cooperatively define a first interior chamber 692 (broadly, a "vent chamber") and a second interior chamber 694 (broadly, a "vacuum chamber") is defined between the closure member 613 and the diaphragm 615.

It is easy for a small child to get a drink out of the drinking cup 601 by placing her lips around the spout 646 so as to form a seal with the spout, tilting the cup (e.g., as seen in FIG. 27) so that liquid in the container 603 flows into contact with the lid assembly, and sucking on the spout. Sucking on the spout 646 removes some of the air from the second interior chamber 694 of the cup 601, vacuum is thus drawn on the second interior chamber 694, causing the diaphragm 615 to move from a sealed position to an unsealed position. In this embodiment, the sloped lower surface 668*a* of the base member 688 of the closure member 613 directs liquid in the container toward the central opening 688 as illustrated by arrows 691. As the volume of liquid within the container 603 is reduced, the sloped lower surface 688*b* funnels the remaining liquid toward the central opening 688 where it can pass through the closure member 613 and into the second interior chamber 694. From the second interior chamber 694, the liquid can flow freely into the channel 647 in the spout 646 and out the opening 645 therein for consumption by the child using the cup 601.

Figure 28:
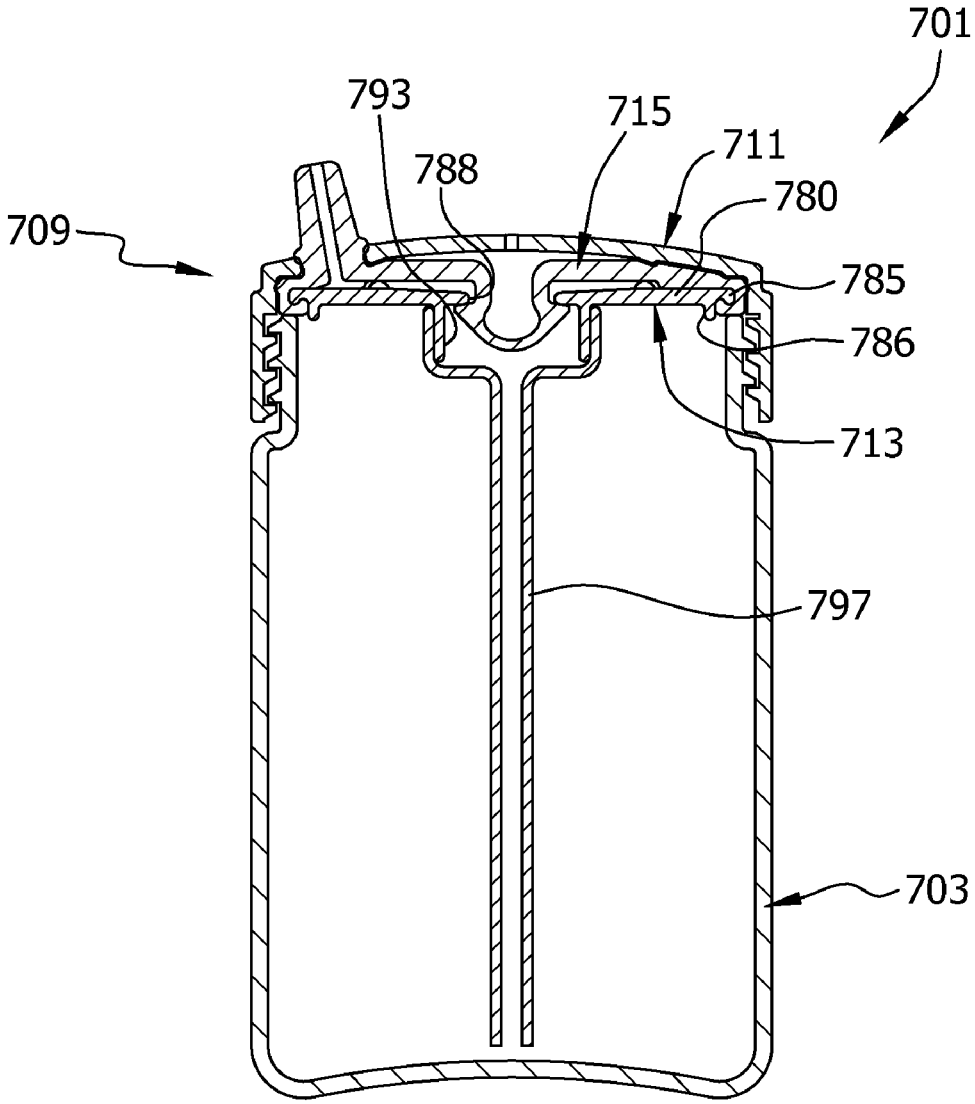
FIG. 28 is a vertical cross-section of still yet another embodiment of a leak resistant drinking cup, the cup having a longitudinally extending fluid guide.

FIG. 28 illustrates another embodiment of a leak resistant drinking cup, indicated generally at 701, having a container 703 and a lid assembly 709. The lid assembly 709 comprises a cover 711, a closure member 713, and a diaphragm 715 disposed between the cover and the closure member. The illustrated cover 711 and diaphragm 715 are substantially the same as the cover 611 and diaphragm 615 illustrated in FIG. 27 and therefore will not be described in detail.

The closure member 713 of the lid assembly 709 comprises a base member 780 having a central opening 788 therethrough. The base member 780 has a mounting band 785 extending about its circumference. A first annular rib 786 is spaced inward from the mounting band 785 and extends downward from the base member 780. A second annular rib 793 is located between the first annular rib 786 and the central opening 788. In the illustrated embodiment, the second annular rib 793 is disposed generally adjacent the central opening 788. A longitudinally extending fluid guide tube 797 is frictionally attached to the second annular rib 793. During use of the cup 701, the fluid guide tube 797 directs fluid toward a sealing member of the diaphragm 715.

Figure 29:
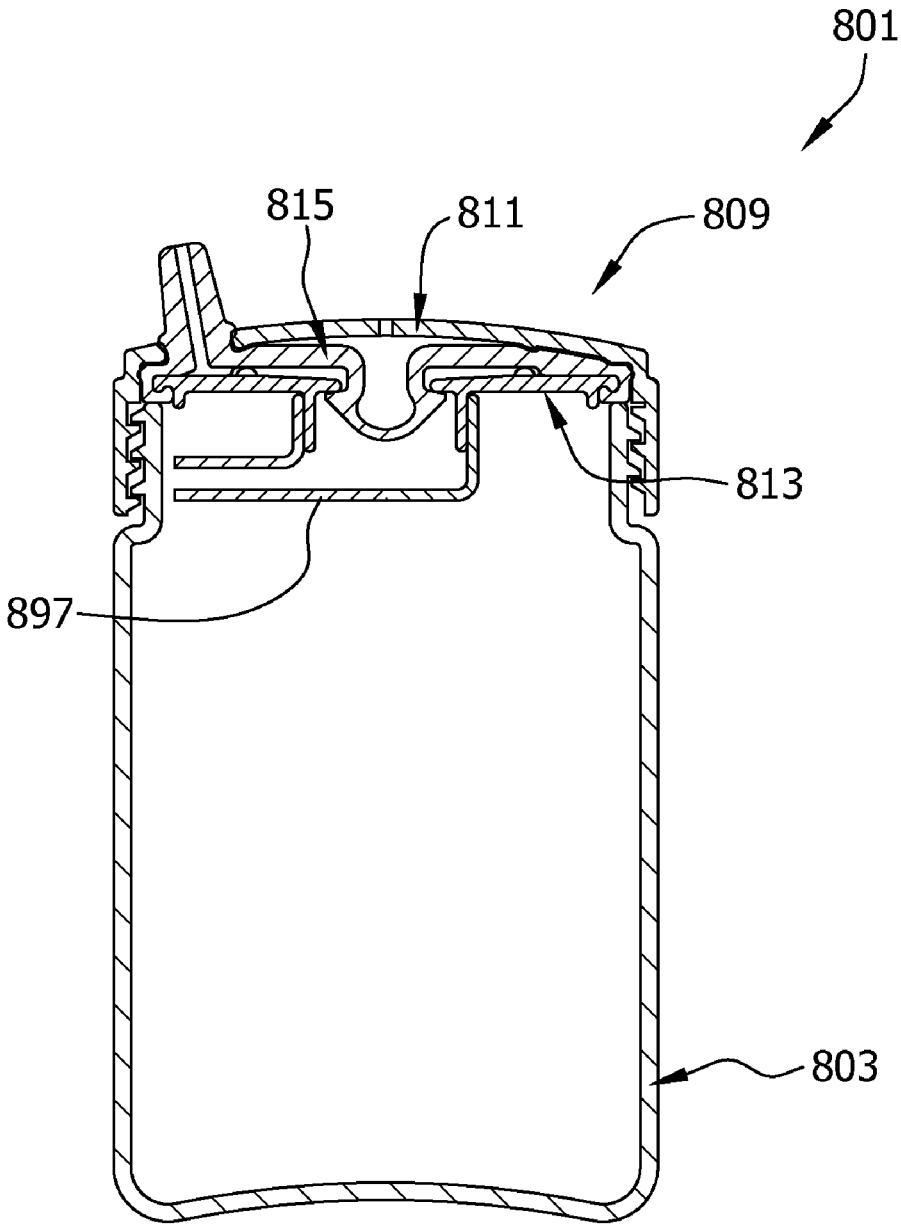
FIG. 29 is a vertical cross-section of another embodiment of a leak resistant drinking cup, the cup having a transverse extending fluid guide.

FIG. 29 illustrates another embodiment of a leak resistant drinking cup, indicated generally at 801, having a container 803 and a lid assembly 809. The lid assembly 809 comprises a cover 811, a closure member 813, and a diaphragm 815 disposed between the cover and the closure member. The illustrated cover 811, closure member 813, and diaphragm 815 are substantially the same as the cover 711, closure member 713, and diaphragm 715 illustrated in FIG. 28 and therefore will not be described in detail. This embodiment of the cup 801, however, has a transversely extending fluid guide tube 897 that is frictionally attached to the closure member 813. During use of the cup 801, the fluid guide tube 897 directs fluid toward a sealing member of the diaphragm 815.

Figure 30:
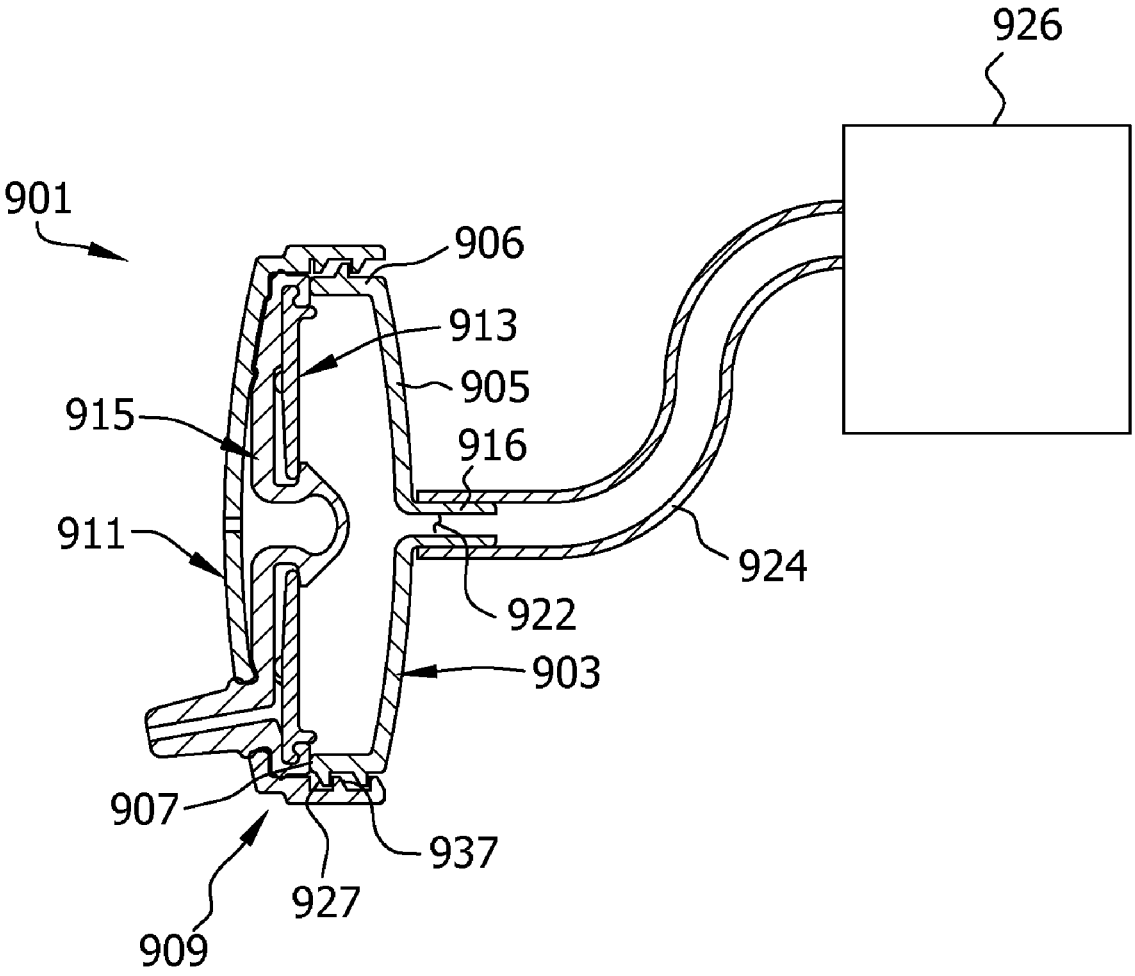
FIG. 30 is a vertical cross-section of an embodiment of a leak resistant drinking appliance being operatively connected to a source of liquid.

FIG. 30 illustrates one embodiment of a leak resistant drinking appliance, indicated generally at 901. The drinking appliance 901 has a container 903 and a lid assembly 909. The lid assembly 909 comprises a cover 911, a closure member 913, and a diaphragm 915 disposed between the cover and the closure member. The illustrated cover 911, closure member 913, and diaphragm 915 are substantially the same as the cover 711, closure member 713, and diaphragm 715 illustrated in FIG. 28 and therefore will not be described in detail.

The container 903 of the drinking appliance 901 has a bottom 905, a top 907, and a generally cylindrical side wall 906 extending between the bottom and the top. The cylindrical side wall 906 has external threads 927 thereon for mating with internal threads 937 on the cover 911. The bottom 905 includes a flange 916 defining a port 922 in fluid communication with the interior space of the container 903. In the illustrated embodiment, a flexible tubing 924 fluidly connects a source of liquid 926 to the container 903. The source of liquid 926 provides liquid to the drinking apparatus for consumption by the user. In one suitable embodiment, the drinking apparatus 901 can be used to supply hospital patients with water (or other drinkable liquids). In this embodiment, the source of liquid 926 can be a bag of water hanging from a conventional IV pole. In another embodiment, the drinking apparatus 901 can be used in conjunction with a "beer helmet" or "beer hat" (i.e., headwear adapted to hold one or more containers of beer or other beverage). Liquid can be provided to the drinking apparatus 901 from the source of liquid 926 via gravity or by pressurization of the source of liquid 926.

When introducing elements of the present invention or the various versions, embodiment(s) or aspects thereof, the articles "a", "an", "the" and "said" are intended to mean that there are one or more of the elements. The terms "comprising", "including" and "having" are intended to be inclusive and mean that there may be additional elements other than the listed elements. The use of terms indicating a particular orientation (e.g., "top", "bottom", "side", etc.) is for convenience of description and does not require any particular orientation of the item described.

As various changes could be made in the above without departing from the scope of the invention, it is intended that all matter contained in the above description and shown in the accompanying drawings shall be interpreted as illustrative and not in a limiting sense.

What is claimed is:

1. A leak resistant drinking cup comprising:

a container having a liquid chamber for receiving and holding a quantity of liquid for drinking, the container having an open top; and a lid assembly adapted for removable attachment to the container for selectively closing the open top, the lid assembly comprising:

a liquid discharge member through which liquid in the container exits the cup during drinking;

a closure member adapted for placement adjacent the open top of the container when the lid assembly is attached to the container;

a flexible diaphragm disposed at least in part between the liquid discharge member and the closure member, the diaphragm being moveable between a sealed position in which the diaphragm blocks the flow of liquid from the container to the liquid discharge member, and an unsealed position in which liquid is permitted to flow from the container to the liquid discharge member, the diaphragm being moveable from the sealed position to the unsealed position by a vacuum applied to the diaphragm by a user sucking on the liquid discharge member, the vacuum causing the diaphragm to flex toward the container and at least in part away from the closure member and thereby move the diaphragm from the sealed position to the unsealed position; and at least one protuberance positioned between an upper surface of the closure member and a lower surface of the diaphragm, the at least one protuberance configured as a stop to control flexing of the diaphragm with respect to the closure member.

2. The leak resistant drinking cup as set forth in claim 1 wherein the closure member is adapted for releasable coupling with the diaphragm.

3. The leak resistant drinking cup as set forth in claim 2 wherein the diaphragm includes a sealing member and the closure member includes a central opening, the sealing member being configured for insertion through the central opening of the closure member to releasably couple the closure member with the diaphragm, the sealing member being adapted to form a seal with a portion of the closure member adjacent the central opening in the sealed position of the diaphragm.

4. The leak resistant drinking cup as set forth in claim 3 wherein the closure member and the diaphragm cooperatively define a vacuum chamber in communication with the liquid discharge member such that the vacuum is drawn on the vacuum chamber when the user sucks on the liquid discharge member.

5. The leak resistant drinking cup as set forth in claim 1 wherein the closure member includes the at least one protuberance that acts as a fulcrum about which the diaphragm flexes during movement of the diaphragm between the sealed position and the unsealed position.

6. The leak resistant drinking cup as set forth in claim 1 wherein the at least one protuberance acts as the stop upon flexure of the diaphragm.

7. The leak resistant drinking cup as set forth in claim 1 further comprising a cover selectively engageable with the container, the cover and container cooperatively capturing the diaphragm when the cover is engaged with the container.

8. The leak resistant drinking cup as set forth in claim 1 wherein the diaphragm and the liquid discharge member are formed as one-piece.

9. The leak resistant drinking cup as set forth in claim 8 wherein the liquid discharge member is a spout.

10. A leak resistant drinking cup comprising:

a container having a liquid chamber for receiving and holding a quantity of liquid for drinking, the container having an open top; and a lid assembly adapted for removable attachment to the container for selectively closing the open top, the lid assembly comprising:

a liquid discharge member for allowing liquid in the container to exit the cup during drinking;

a flexible diaphragm moveable between a sealed position in which the diaphragm blocks the flow of liquid from the container to the liquid discharge member, and an unsealed position in which liquid is permitted to flow from the container to the liquid discharge member, the diaphragm being biased toward the sealed position and away from the container;

a closure member cooperative with the diaphragm to define a vacuum chamber within the lid assembly and separate from the liquid chamber within the container; and at least one protuberance positioned between an upper surface of the closure member and a lower surface of the diaphragm, the at least one protuberance configured as a stop to control flexing of the diaphragm with respect to the closure member.

11. The leak resistant drinking cup as set forth in claim 10, wherein the vacuum chamber has a first volume when the diaphragm is in the sealed position and a second volume when the diaphragm is in the unsealed position, the second volume being less than the first volume.

12. The leak resistant drinking cup as set forth in claim 11 wherein the closure member is adapted for releasable coupling with the diaphragm.

13. The leak resistant drinking cup as set forth in claim 11 wherein the diaphragm includes an outwardly extending stem and a mushroom-shaped tip attached to the stem, the closure member including a central opening and being releasably coupled to the diaphragm upon insertion of the mushroom-shaped tip of the diaphragm through the central opening.

14. The leak resistant drinking cup as set forth in claim 13 wherein the mushroom-shaped tip includes a slit therein to provide a one-way valve to relieve excessive vacuum inside the container.

15. The leak resistant drinking cup as set forth in claim 10 wherein the closure member includes the at least one protuberance that acts as a fulcrum about which the diaphragm flexes during movement of the diaphragm between the sealed position and the unsealed position.

16. The leak resistant drinking cup as set forth in claim 10 wherein the at least one protuberance acts as the stop upon flexure of the diaphragm.

17. The leak resistant drinking cup as set forth in claim 10 further comprising a cover selectively engageable with the container, the cover and container cooperatively capturing the diaphragm when the cover is engaged with the container.

18. A leak resistant drinking cup comprising:

a container having a liquid chamber for receiving and holding a quantity of liquid for drinking, the container having an open top; and a lid assembly adapted for removable attachment to the container for selectively closing the open top, the lid assembly comprising:

a liquid discharge member for allowing liquid in the container to exit the cup during drinking;

a closure member adapted for placement adjacent the open top of the container when the lid assembly is attached to the container;

a flexible diaphragm moveable between a sealed position in which the diaphragm blocks the flow of liquid from the container to the liquid discharge member, and an unsealed position in which liquid is permitted to flow from the container to the liquid discharge member, wherein the diaphragm is urged toward its sealed position by pressure within the container and at least one protuberance positioned between an upper surface of the closure member and a lower surface of the diaphragm, the at least one protuberance configured as a stop to control flexing of the diaphragm with respect to the closure member.

19. The leak resistant drinking cup as set forth in claim 18 wherein the container is a rigid container.

20. The leak resistant drinking cup as set forth in claim 18 wherein the container is a non-rigid container.

21. The leak resistant drinking cup as set forth in claim 20 wherein squeezing the non-rigid container increases the pressure within the liquid chamber of the container thereby urging the sealing member toward its sealed position.

22. The leak resistant drinking cup as set forth in claim 18 wherein the closure is configured to direct liquid within the container toward the diaphragm when the cup is tilted for drinking.

23. The leak resistant drinking cup as set forth in claim 18 further comprising a fluid guide tube for guiding liquid within the liquid chamber of the container toward the flexible diaphragm.

24. The leak resistant drinking cup as set forth in claim 18 wherein the closure member is configured to close the open top of the container when the lid assembly is attached to the container, the closure member being sized to cover the entire open top of the container.

25. The leak resistant drinking cup as set forth in claim 18 wherein the at least one protuberance comprises at least one upper protuberance arranged annularly about the closure member, the upper protuberance configured to act as a fulcrum about which the diaphragm flexes.

26. The leak resistant drinking cup as set forth in claim 18 wherein the at least one protuberance comprises at least one annular rib extending upward from the closure member.

27. The leak resistant drinking cup as set forth in claim 26 wherein the at least one annular rib comprises a plurality of elongated ribs spaced apart from each other such that a gap is defined between adjacent ribs of the plurality of ribs.

28. The leak resistant drinking cup as set forth in claim 18 further comprising a mounting band extending about a circumference of the closure member, the mounting band extending above an upper surface of the closure member.

29. The leak resistant drinking cup as set forth in claim 18 wherein the at least one protuberance is spaced inwardly from a circumferential edge of the closure member.

* * * * *